US011879105B2

(12) United States Patent
Anderson et al.

(10) Patent No.: US 11,879,105 B2
(45) Date of Patent: Jan. 23, 2024

(54) MARINE FUEL COMPOSITIONS WITH ACCEPTABLE WAX BEHAVIOR

(71) Applicant: ExxonMobil Technology and Engineering Company, Annandale, NJ (US)

(72) Inventors: Timothy J. Anderson, Chatham, NJ (US); Erin R. Fruchey, Philadelphia, PA (US); Suzanne R. Golisz, Annandale, NJ (US); Kenneth C. H. Kar, Philadelphia, PA (US); Sheryl B. Rubin-Pitel, Newtown, PA (US)

(73) Assignee: EXXONMOBIL TECHNOLOGY AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 17/244,222

(22) Filed: Apr. 29, 2021

(65) Prior Publication Data

US 2021/0246391 A1 Aug. 12, 2021

Related U.S. Application Data

(63) Continuation-in-part of application No. 16/716,875, filed on Dec. 17, 2019, now Pat. No. 10,995,290.

(60) Provisional application No. 62/816,642, filed on Mar. 11, 2019.

(51) Int. Cl.
*C10L 1/08* (2006.01)

(52) U.S. Cl.
CPC ..... *C10L 1/08* (2013.01); *C10L 2200/0438* (2013.01); *C10L 2270/026* (2013.01)

(58) Field of Classification Search
CPC ..... C10L 1/08; C10L 2200/0438; C10L 2270/026
See application file for complete search history.

(56) References Cited

U.S. PATENT DOCUMENTS 3,556,160 A * 1/1971 Link ..... F02B 1/00 137/467.5
4,252,097 A * 2/1981 Hartford ..... F02D 41/32 73/32 R (Continued)

FOREIGN PATENT DOCUMENTS

WO 2020/112096 A1 6/2020

OTHER PUBLICATIONS

International Search Report and Written Opinion of PCT/US2019/066753 dated Jul. 2, 2020.

(Continued)

*Primary Examiner* — Cephia D Toomer
(74) *Attorney, Agent, or Firm* — Shook, Hardy & Bacon L.L.P.

(57) ABSTRACT

Provided are marine fuel compositions having acceptable wax behavior. In one form, the marine fuel composition has the following enumerated properties: a kinematic viscosity at 50° C. of about 5 cSt to about 700 cSt; a wax endpoint temperature of less than about 100° C.; and a ratio of kinematic viscosity at 100° C. to operating viscosity greater than 1, wherein the operating viscosity is at least about 2 cSt. The marine fuel composition exists in a liquid phase with essentially all the wax in the composition melted (essentially free of solid wax) prior to fuel injection into a marine engine.

21 Claims, 16 Drawing Sheets

(56) References Cited

U.S. PATENT DOCUMENTS

| | | | | |
|---|---|---|---|---|
| 5,085,198 | A * | 2/1992 | Bartlett | F02M 53/02 123/514 |
| 8,999,011 | B2 | 4/2015 | Stern et al. | |
| 9,057,035 | B1 | 6/2015 | Kraus et al. | |
| 10,995,290 | B2 * | 5/2021 | Anderson | G01N 11/00 |
| 2009/0178951 | A1 | 7/2009 | Balthasar et al. | |
| 2012/0246999 | A1 | 10/2012 | Stern et al. | |
| 2013/0226438 | A1 * | 8/2013 | Schroeder | F02D 41/0025 701/104 |
| 2015/0240174 | A1 | 8/2015 | Kraus et al. | |
| 2015/0340126 | A1 | 11/2015 | Kimura | |
| 2017/0002273 | A1 | 1/2017 | Rubin-Pitel et al. | |
| 2017/0044451 | A1 | 2/2017 | Kar et al. | |
| 2018/0155647 | A1 | 6/2018 | Robinson et al. | |

OTHER PUBLICATIONS

ISO 8217-2010 standards. (Year: 2010).

"CIMAC Guideline—Cold flow properties of marine fuel oils", CIMAC WG7 Fuels, International Council on Combustion Engines, First Edition, pp. 1-9 (Jan. 2015).

International Search Report and Written Opinion received for PCT Patent Application No. PCT/US2021/030058, dated Jan. 19, 2022, 10 pages.

* cited by examiner

| Component | Density at 15°C, g/cm³ | Kinematic Viscosity at 40°C, cSt | Kinematic Viscosity at 50°C, cSt | Kinematic Viscosity at 100°C, cSt | Sulfur, wt% | Pour Point, °C | Carbon Residue, wt% | N-Heptane Insolubles, wt% | Wax Endpoint, °C |
|---|---|---|---|---|---|---|---|---|---|
| Heavy Fraction C1 | 0.9820 | 1362 | 638.7 | 51.98 | 1.67 | 9 | 12.6 | 3.5 | 88 |
| Heavy Fraction C2 | 0.9781 | - | 652.0 | 44.75 | 1.56 | 9 | 11.2 | - | 88 |
| Heavy Fraction C3 | 0.9766 | - | 410.5 | 48.47 | 1.30 | 0 | 12.6 | - | 87 |
| Heavy Fraction C4 | 0.9732 | - | 593.7 | 48.17 | 1.34 | 18 | 11.3 | - | 89 |

*FIG. 5.*

Log10 (KV) = mT + b
m = -0.02364
b = 2.381

Solving for WFV:

If WEP = 88°C and OV = 12 cSt, then $$WFV = 10^{[\log10(12) - (-0.02364 \times (88 - 50))]}$$

WFV = 94.9 cSt

If WEP = 88°C and OV = 2 cSt, then $$WFV = 10^{[\log(2) - (-0.02364 \times (88 - 50))]}$$

WFV = 15.8 cSt

| | Heavy Fraction C1 | Distillate Flux 1 | Distillate Flux 2 | Fuel A | Fuel B |
|---|---|---|---|---|---|
| Heavy Fraction C1 vol% | 100 | 0 | 0 | 25 | 25 |
| Distillate Flux 1 vol% | 0 | 100 | 0 | 75 | 0 |
| Distillate Flux 2 vol% | 0 | 0 | 100 | 0 | 75 |
| Density at 15°C, g/cm$^3$ | 0.9820 | 0.8514 | 0.8502 | 0.8855 | 0.8840† |
| Sulfur, wt% | 1.67 | 0.0003 | 0.0006 | 0.46† | 0.46† |
| Kinematic Viscosity at 40°C, cSt | 1362 | 2.888 | 2.870 | 8.615 | 7.270 |
| Kinematic Viscosity at 50°C, cSt | 638.7 | 2.500 | 2.200 | 6.618 | 5.741 |
| Kinematic Viscosity at 100°C, cSt | 51.98 | - | - | 2.481 | 2.209 |
| Pour Point, °C | 9 | - | - | -76 | -73 |
| Carbon Residue, wt% | 12.6 | 0† | 0† | 3.5† | 3.5† |
| N-Heptane Insolubles, wt% | 3.5 | 0† | 0† | 0.97† | 0.97† |
| CCAI | 838 | - | - | 817 | 820 |
| Wax Endpoint, °C | 88 | - | - | 66 | 69 |

†Estimated or calculated value

*FIG. 7.*

Log10 (KV) = mT + b
m = -0.00901
b = 0.8417

Solving for WFV:

If WEP = 66°C and OV = 12 cSt, then $$WFV = 10^{[\log10(12) - \{-0.00901 \times (66 - 50)\}]}$$

WFV = 16.7 cSt

If WEP = 66°C and OV = 2 cSt, then $$WFV = 10^{[\log(2) - \{-0.00901 \times (66 - 50)\}]}$$

WFV = 2.79 cSt

Log10 (KV) = mT + b
m = -0.00862
b = 1.674

Solving for WFV:

If WEP = 69°C and OV = 12 cSt, then $$WFV = 10^{[\log10(12) - \{-0.00862 \times (69 - 50)\}]}$$

WFV = 17.5 cSt

If WEP = 69°C and OV = 2 cSt, then $$WFV = 10^{[\log(2) - \{-0.00862 \times (69 - 50)\}]}$$

WFV = 2.92 cSt

| | Heavy Fraction A1 | Heavy Fraction B3 | Distillate Flux B2 | Distillate Flux C3 | Fuel C | Fuel D |
|---|---|---|---|---|---|---|
| Heavy Fraction A1 vol% | 100 | 0 | 0 | 0 | 25.8 | 39.6 |
| Heavy Fraction B3 vol% | 0 | 100 | 0 | 0 | 20 | 7 |
| Distillate Flux B2 vol% | 0 | 0 | 100 | 0 | 45.17 | 39.54 |
| Distillate Flux C3 vol% | 0 | 0 | 0 | 100 | 7.31 | 11.22 |
| Density at 15°C, g/cm$^3$ | 1.0000 | 0.9924 | 0.8500 | 0.9393 | 0.9245 | 0.9344 |
| Sulfur, wt% | 1.2 | 1.7 | 0.004 | 0.77 | - | - |
| Distillation Method | - | - | D2887 | D2887 | - | - |
| Distillation T10, °C | - | - | 224.5 | 359.5 | - | - |
| Distillation T50, °C | - | - | 280.5 | 419 | - | - |
| Distillation T90, °C | - | - | 347.1 | 460.5 | - | - |
| Kinematic Viscosity at 40°C, cSt | - | - | - | - | 32.17 | 72.06 |
| Kinematic Viscosity at 50°C, cSt | 200000† | 50.00 | 2.60 | 19.60 | 20.57 | 48.33 |
| Kinematic Viscosity at 100°C, cSt | - | - | - | - | 5.51 | 9.00 |
| Pour Point, °C | - | | - | - | - | - |
| Wax Endpoint, °C | - | 62 | 20 | 50 | 81 | 81 |

†Estimated or calculated value

*FIG. 10.*

| Blend Component | Density, g/cm³ | Viscosity at 50°C, cSt | Sulfur, wt% | Distillation T10, °C | Distillation T50, °C | Distillation T90, °C | Distillation Method | Wax content (wt%) | Wax Endpoint, °C | Wax Flow Viscosity[a], cSt |
|---|---|---|---|---|---|---|---|---|---|---|
| DF A1 | 0.8749 | 18.62 | 0.0005 | 306.2 | 376.2 | 399.9 | D86 | | 35 | |
| DF A2 | 0.9236 | 48.2 | 0.3144 | 339 | 466 | 632 | D7169 | | not tested | |
| DF A3 | 0.9068 | 64.3 | 0.2284 | 339 | 466 | 632 | D7169 | 2.5 | 64 | 18.3 |
| DF B1 | 0.8390 | 1.9 | 0.0053 | 201 | 250.8 | 324 | D86 | | not tested | |
| DF B2 | 0.8500 | 2.60 | 0.004 | 224.5 | 280.5 | 347.1 | D2887 | 10.5 | 20 | 5.3 |
| DF B3 | 0.8548 | 4.27 | 0.0526 | 229 | 325 | 400 | D86 | | not tested | |
| DF C1 | 0.9985 | 2.00 | 1.13 | 222 | 243 | 289 | D86 | | not tested | |
| DF C2 | 0.9795 | 8.89 | 1.15 | 320.6 | 346.9 | 370.7 | D86 | | not tested | |
| DF C3 | 0.9393 | 19.60 | 0.77 | 359.5 | 419 | 460.5 | D2887 | 8.6 | 50 | 12 |
| DF C4 | 0.8830 | 1.691 | 0.098 | 204 | 262.4 | 318.7 | D86 | 1.65 | 1 | 3.4 |
| HF A1 | 1.0000 | 200000 | 1.2 | not tested | not tested | not tested | | | not tested | |
| HF A2 | 0.9732 | 593.70 | 1.34 | 326 | 582 | 727 | D2887 | | 89 | |
| HF A3 | 0.9328 | 575 | 0.5109 | 324 | 610 | 731 | D7169 | | not tested | |
| HF A4 | 0.9715 | 1878 | 0.71 | not tested | not tested | not tested | | | not tested | |
| HF A5 | 0.9395 | 941 | 0.68 | 299 | 607 | 705 | D6352 | | not tested | |
| HF A6 | 0.9779 | 3020 | 2.38 | 476 | 613 | 729 | D2887 | | 104 | |
| HF A7 | 1.004 | 708432 | 0.81 | 569 | 659 | | D6352 | | not tested | |
| HF B1 | 0.9359 | 25.51 | 0.17 | 351 | 440 | | D86 | 13.5 | 49 | 11.6 |
| HF B2 | 0.9227 | 25.68 | 0.14 | 350 | 424.5 | | D86 | 14.3 | 50 | 12 |
| HF B3 | 0.9924 | 50.00 | 1.7 | not tested | not tested | not tested | | 6.6 | 62 | 17.2 |

†Wax flow viscosity is calculated using operating viscosity equal to 12 cSt.

*FIG. 13.*

| FUEL | Blend Recipe, vol % | Density @ 15°C, g/cm³ | Sulfur, wt% | KV50, cSt | Asphaltenes, wt% | Pour Point, °C | MCR, wt% | Flash Point, °C | T10 (sim dis), °C | T50 (sim dis), °C | T90 (sim dis), °C | Wax content (wt%) | Wax Endpoint, °C | Wax Flow Viscosity, cSt | Ratio, KV50 to Wax Flow Viscosity |
|---|---|---|---|---|---|---|---|---|---|---|---|---|---|---|---|
| Fuel 1 | HF A4, 58<br>DF B1, 42 | 0.9019 | 0.4249 | 30.3 | | -9 | 5.03 | | | | | 1.8 | 80 | 29.6 | 1.02 |
| Fuel 2 | HF A5, 68<br>DF B1, 32 | 0.9069 | 0.484 | 53.7 | 0.82 | -50 | 5.65 | 83 | 209 | 539 | 679 | 2.3 | 83 | 34.5 | 1.56 |
| Fuel 3 | HF A1, 41<br>DF B2, 30<br>DF C3, 22 | 0.9434 | 0.85 | 66.8 | 2.6 | 30 | 10 | 87 | 227 | 415 | 660 | | 99 | 62 | 1.08 |
| Fuel 4 | HF A6, 67.3<br>DF C1, 12 | 0.9492 | 1.8 | 72 | | | | | 227 | 583 | n.d. | | 100 | 65 | 1.11 |
| Fuel 5 | HF A2, 1.36<br>DF A1, 76<br>DF B3, 22<br>DF C2, 0.64 | 0.8745 | 0.0351 | 11.51 | | | | | | | | | 35 | 8 | 1.44 |
| Fuel 6 | HF A2, 1.36<br>DF A1, 98<br>DF C2, 0.64 | 0.88 | 0.034 | 20.18 | | | | | | | | | 35 | 8 | 2.52 |
| Fuel 7 | HF A2, 3.4<br>DF A1, 58<br>DF B3, 18<br>DF C2, 20.6 | 0.8973 | 0.339 | 11.61 | | | | | | | | | 35 | 8 | 1.45 |
| Fuel 8 | DF A1, 100 | 0.8749 | 0.0005 | 18.62 | | | | | | | | | 35 | 8 | 2.33 |
| Fuel 9 | HF A1, 37.2<br>HF B3, 14<br>DF B2, 35.78<br>DF C3, 10.54 | 0.9396 | | 50.91 | 1.9 | 18 | | | | | | 5.7 | 81 | 34.8 | 1.46 |
| Fuel 10 | HF A1, 48<br>DF B2, 35.2<br>DF C3, 13.6 | 0.9425 | | 88.15 | 3.8 | 18 | | | | | | 5.54 | 89 | 53.1 | 1.66 |
| Fuel 11 | HF A6, 75<br>DF B3, 25<br>DF B2, 5 | 0.9332 | 1.15 | 79.8 | | | | | | | | | 96 | 48 | 1.66 |
| Fuel 12 | HF A7, 75<br>DF B3, 25 | 0.9410 | 0.445 | 212 | | | | | | | | | 100 | 65 | 3.26 |
| Fuel 13 | HF A4, 80<br>DF A3, 20 | 0.9273 | 0.4618 | 352 | | 3 | 5.9 | 100 | | | | 3.3 | 80 | 52.6 | 6.69 |

*Cont. on 14B.*

*FIG. 14A.*

*Cont. from 14A.*

| | | | | | | | | | | | | | | | |
|---|---|---|---|---|---|---|---|---|---|---|---|---|---|---|---|
| Fuel 14 | HF A4, 41<br>DF A3, 47<br>DF B1, 12 | 0.9083 | 0.3224 | 66.6 | | 9 | 4 | 81 | | | | 3.0 | 73 | 28.1 | 2.37 |
| Fuel 15 | HF A4, 28<br>DF A3, 65<br>DF B1, 7 | 0.9084 | 0.2914 | 67.1 | | 12 | 3.19 | 95 | | | | 1.9 | 71 | 26.3 | 2.55 |
| Fuel 16 | HF A1, 45.6<br>DF B2, 38.44<br>DF C3, 12.92 | 0.9376 | | 66.68 | 3.5 | 15 | | | | | | 4.2 | 89 | 49 | 1.36 |
| Fuel 17 | HF A2, 16.4<br>DF A2, 64.7<br>DF B1, 18.9 | 0.9154 | 0.4300 | 23.3 | | 27 | 1.86 | 87 | | | | 2.8 | 71 | 23.0 | 1.01 |

†Wax flow viscosity is calculated using operating viscosity equal to 12 cSt.

*FIG. 14B.*

| FUEL | Blend Recipe, vol % | Density @ 15°C, g/cm³ | Sulfur, wt% | KV50, cSt | Asphaltenes, wt% | Pour Point, °C | MCR, wt% | Flush Point, °C | T10 (sim dis), °C | T50 (sim dis), °C | T90 (sim dis), °C | Wax content (wt%) | Wax Endpoint, °C | Wax Flow Viscosity, cSt | Ratio, KV50 to Wax Flow Viscosity |
|---|---|---|---|---|---|---|---|---|---|---|---|---|---|---|---|
| Fuel 18 | HF A6, 62<br>DF B3, 14<br>DF C1, 24 | 0.9599 | | 61 | | | | | | | | | 98.5 | 61 | 1.00 |
| Fuel 19 | HF A1, 31.8<br>HF B3, 17<br>DF B2, 40.07<br>DF C3, 9.01 | 0.9328 | | 33.43 | 1.9 | 15 | | | | | | 4.8 | 85 | 36.1 | 0.926 |
| Fuel 20 | HF A1, 17<br>DF B2, 70<br>DF C3, 10 | 0.8901 | 0.38 | 7.84 | 1.2 | 9 | 4.52 | 76 | 210 | 314 | 618 | 24.2 | 87 | 40 | 0.196 |
| Fuel 21 | HF A1, 11<br>HF B3, 6<br>DF B2, 75<br>DF C3, 6 | 0.8844 | 0.3 | 6.097 | 1.0 | | 3.27 | 81 | 211 | 308 | 557 | 22.7 | 87 | 40 | 0.152 |
| Fuel 22 | HF A2, 24<br>DF A1, 65<br>DF C2, 11 | 0.9095 | 0.507 | 46.9 | | | | | | | | 4.4 | 95 | 53 | 0.885 |
| Fuel 23 | HF A6, 15.2<br>DF B3, 77.4<br>DF B2, 2.7 | 0.8944 | 0.769 | 12.4 | | | | | | | | 18.1 | 78 | 29 | 0.428 |
| Fuel 24 | HF A6, 8.7<br>DF B3, 87<br>DF B2, 1.6 | 0.8767 | 0.28 | 8.885 | | | | | | | | 19.3 | 72 | 24 | 0.370 |
| Fuel 25 | HF A1, 42.6<br>DF B2, 42.49<br>DF C3, 12.07 | 0.9307 | | 43.89 | 3.0 | 9 | | | | | | 4.4 | 89 | 44.4 | 0.989 |

*FIG. 15.*

MARINE FUEL COMPOSITIONS WITH ACCEPTABLE WAX BEHAVIOR

CROSS REFERENCE TO RELATED APPLICATIONS

This application is a Continuation-in-Part Application and claims priority to pending U.S. application Ser. No. 16/716,875 filed on Dec. 17, 2019, the entirety of which is incorporated herein by reference, which claims the benefit of U.S. Provisional Application Ser. No. 62/816,642 filed Mar. 11, 2019 which is also herein incorporated by reference in its entirety.

FIELD

This application relates to marine fuel compositions and, more particularly, embodiments relate to marine fuel compositions that have acceptable wax behavior, i.e. no wax-related filter plugging during operation of a marine vessel.

BACKGROUND

Marine fuel compositions, sometimes referred to as bunker fuel, have conventionally included heavy petroleum fractions that may be otherwise difficult and/or expensive to convert to a beneficial use. The heavy petroleum fractions may include heavier distillation fractions that are lightly processed (or even unprocessed), such as vacuum gas oils, heavy atmospheric gas oil, atmospheric tower bottoms, vacuum tower bottoms, and other residual components. Due in part to use of the marine fuel compositions in international waters, the fuels have typically incorporated heavy petroleum fractions with relatively high sulfur content. However, many countries have recently adopted local specifications for lower sulfur emissions from marine vessels. In addition, the International Maritime Organization implemented a new global sulfur limit of 0.50 wt. % sulfur, effective Jan. 1, 2020, commonly referred to as "IMO 2020."

In preparing low-sulfur fuels that are IMO 2020 compliant, different hydrocarbon components can be blended. These different hydrocarbon components can contain wax, such as paraffin wax. Since wax can be problematic, there is a need to manage wax content when making IMO 2020 compliant marine fuel compositions. For example, solid wax in the marine fuel compositions can lead to filter blocking in the fuel handling system and starve the engine of fuel. If solid wax is present, the marine fuel compositions may be heated to melt any wax prior to injection into the engine. However, engine manufacturers also specify an operating viscosity at which the marine fuel composition should be injected into the engine. Raising the temperature of the fuel to melt the wax decreases fuel viscosity. In some cases, raising the temperature of the fuel to melt the wax may result in too low of a viscosity that is unsuitable for operating the marine engine. IMO 2020 compliant fuels may have inherently lower viscosity due to containing more low viscosity flux materials for sulfur correction, thereby increasing the risk that a fuel cannot be heated to melt wax while still maintaining sufficient viscosity for engine operation. Such fuels have unacceptable wax behavior, i.e. wax-related filter plugging would occur during operation of a marine vessel at the desired fuel operating viscosity. Wax-related filter plugging could negatively impact vessel operation by causing more frequent filter changes, or if the filter plugging cannot be managed by filter changes, starving a marine engine of fuel resulting in a loss of propulsion.

SUMMARY

Disclosed herein are marine fuel compositions having acceptable wax behavior, i.e. no wax-related filter plugging during operation of a marine vessel. A fuel composition with acceptable wax behavior may be characterized by any of several desirable properties, such as: (1) a wax endpoint of 100° C. or less measured by DSC in combination with a ratio of kinematic viscosity at 100° C. ("KV100") to operating viscosity greater than 1; (2) a ratio of measured or calculated kinematic viscosity at the wax endpoint to operating viscosity greater than 1; or (3) a ratio of kinematic viscosity at 50° C. ("KV50") to wax flow viscosity of greater than 1. For the purpose of calculating ratios in (1) through (3) above, the operating viscosity used for determining the ratio may be the lowest allowable operating viscosity recommended by the engine manufacturer ("$OV_a$"), the lowest allowable operating viscosity adjusted for test precision ("$OV_{aP}$"), the lowest optimal operating viscosity recommended by the engine manufacturer ("$OV_o$"), or the lowest optimal operating viscosity adjusted for test precision ("$OV_{oP}$").

In one form disclosed herein, provided is a marine fuel composition having the following enumerated properties: a kinematic viscosity at 50° C. of about 5 cSt to about 700 cSt; a wax endpoint temperature of less than about 100° C.; and a ratio of kinematic viscosity at 100° C. to operating viscosity greater than 1, wherein the operating viscosity is at least about 2 cSt. The marine fuel composition exists in a liquid phase with essentially all the wax in the composition melted (essentially free of solid wax) prior to fuel injection into a marine engine.

In another form disclosed herein, provided is a marine fuel composition having the following enumerated properties: a kinematic viscosity at 50° C. of about 5 cSt to about 700 cSt; a wax endpoint temperature of about 35° C. to about 130° C.; and a ratio of kinematic viscosity at wax endpoint temperature to operating viscosity greater than 1, wherein the operating viscosity is at least about 2 cSt, and wherein the marine fuel composition exists in a liquid phase with essentially all the wax in the composition melted (essentially free of solid wax) prior to fuel injection into a marine engine.

In yet another form disclosed herein, provided is a marine fuel composition having the following enumerated properties: a kinematic viscosity at 50° C. of about 5 cSt to about 700 cSt; a wax endpoint temperature of about 35° C. to about 130° C.; and a ratio of kinematic viscosity at 50° C. to wax flow viscosity of greater than 1, wherein the wax flow viscosity is calculated using an operating viscosity of about 2 cSt to about 12 cSt, and wherein the marine fuel composition exists in a liquid phase with essentially all the wax in the composition melted (essentially free of solid wax) prior to fuel injection into a marine engine.

BRIEF DESCRIPTION OF THE DRAWINGS

These drawings illustrate certain aspects of the present invention and should not be used to limit or define the invention.

FIG. 5 describes properties of four unique samples of fuel blending component Heavy Fraction C.

FIG. 7 describes properties of fuel blending components Heavy Fraction C1, Distillate Flux 1, Distillate Flux 2, and the properties of blends Fuel A and Fuel B.

FIG. 10 describes properties of fuel blending components Heavy Fraction A1, Heavy Fraction B3, Distillate Flux B2, Distillate Flux C3, and the properties of blends Fuel C and Fuel D.

FIG. 13 describes properties of ten distillate fluxes and ten heavy fractions which are blended together to generate marine fuel compositions.

FIG. 14 describes properties of a range of marine fuel compositions which are deemed to have acceptable wax behavior based on the approach or calculating a wax flow viscosity using operating viscosity equal to about 12 cSt, and then dividing the marine fuel composition KV50 by the calculated wax flow viscosity.

FIG. 15 describes properties of a range of marine fuel compositions which are deemed to have unacceptable wax behavior based on the approach or calculating a wax flow viscosity using operating viscosity equal to about 12 cSt, and then dividing the marine fuel composition KV50 by the calculated wax flow viscosity.

DETAILED DESCRIPTION

Figure 1:
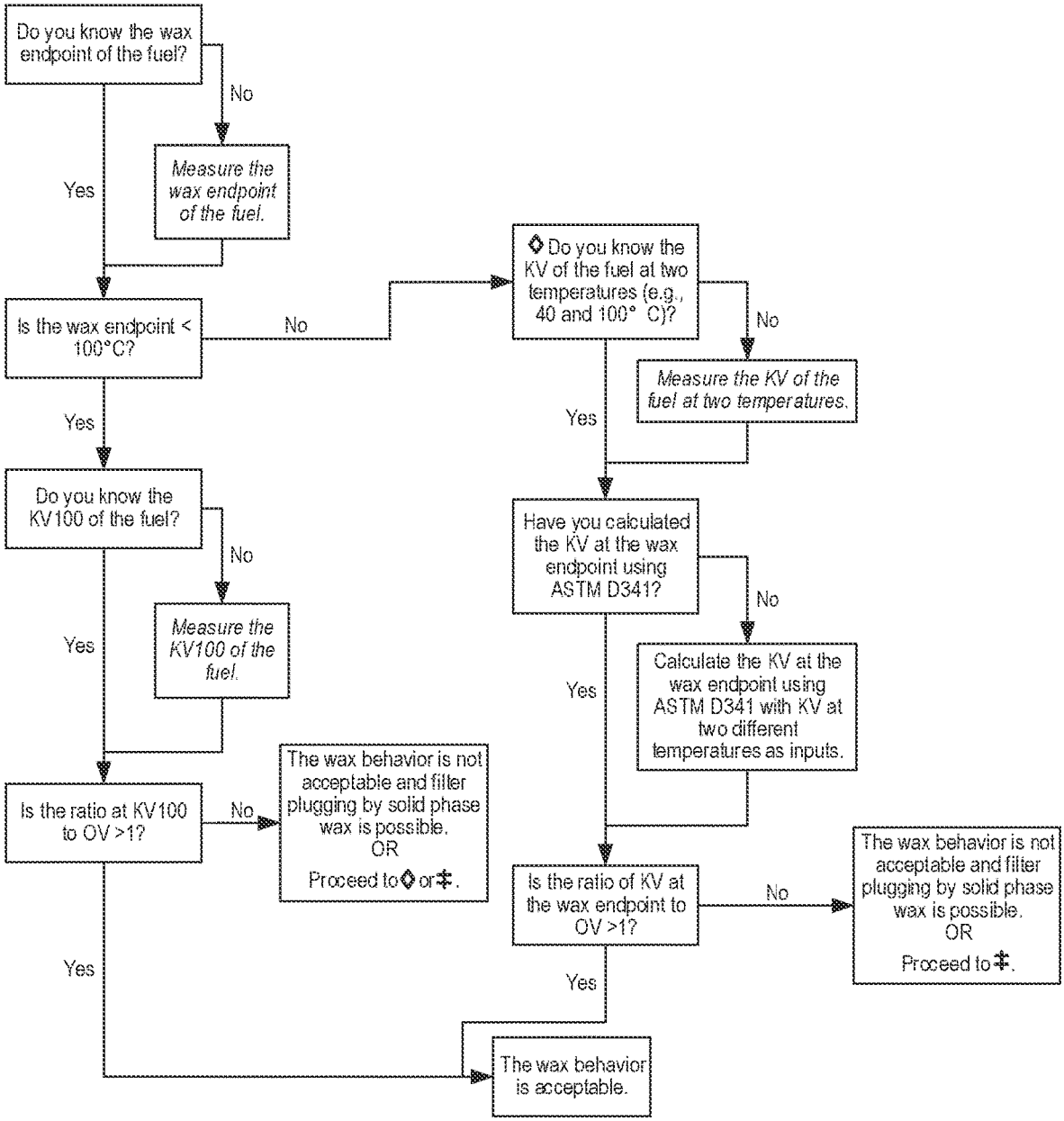
FIG. 1 illustrates a flow chart describing two approaches to determine wax behavior of a marine fuel composition.

In various embodiments, the present disclosure may include marine fuel compositions that are low sulfur and have acceptable wax behavior, i.e. no wax-related filter plugging during operation of a marine vessel. Embodiments disclosed herein may use measured wax endpoint temperatures in combination with measured viscosities at one temperature, such as 100° C., or at two temperatures, such as 40° C. and 100° C. or 50° C. and 100° C., with calculation of viscosity at wax endpoint, or calculation of wax flow viscosity, to provide marine fuel compositions that are essentially free of solid wax as it is being injected into the engine at a desired operating viscosity. The operating viscosity may be selected from a range of values including the lowest allowable operating viscosity recommended by the engine manufacturer ("$OV_a$"), the lowest allowable operating viscosity adjusted for test precision ("$OV_{aP}$"), the lowest optimal operating viscosity recommended by the engine manufacturer ("$OV_o$"), or the lowest optimal operating viscosity adjusted for test precision ("$OV_{oP}$").

As described above, many countries have adopted local specifications for lower sulfur emissions from marine vessels. Even further, IMO 2020 is requiring development of new marine fuel compositions that are low sulfur to meet the new sulfur requirements that are being implemented on Jan. 1, 2020. In addition to IMO 2020, marine fuel compositions classified as residual marine fuels must meet the requirements of ISO 8217, Fuel Standard Sixth Edition 2017, Table 2.

To provide marine fuel compositions that are low sulfur, embodiments may include blending conventional hydrocarbon components, such as heavy petroleum fractions, that are typically higher in sulfur content with a distillate flux that is typically lower in sulfur content. While this can provide marine fuel compositions with desirable sulfur concentrations, embodiments may further include monitoring the viscosity and wax content of the marine fuel compositions and selecting a suitable fuel system temperature on a marine vessel to ensure adequate flowability at the desired fuel viscosity without undesirable wax-related filter plugging. For example, the heavy petroleum fractions typically have a high viscosity while fluxes typically have a low viscosity. The use of fluxes that are lower sulfur in embodiments of the marine fuel compositions can reduce the viscosity of the marine fuel composition to levels that may be lower than pre-2020 marine fuel compositions. In some embodiments, the marine fuel compositions may contain one or more renewable blending components.

Examples of suitable marine fuel compositions may include a hydrocarbon component or blend of two or more hydrocarbon components such that the marine fuel compositions have the properties enumerated herein, such as one or more of sulfur content, density, kinematic viscosity at about 50° C. ("KV50"), wax endpoint, and acceptable wax behavior, i.e. no wax-related filter plugging during operation of a marine vessel. By way of example, a marine fuel composition may include a heavy petroleum fraction and/or a distillate flux. The heavy petroleum fraction typically may include long-chain paraffinic molecules that can form a solid wax at moderate temperatures, such as ambient to about 130° C. In addition to problems with wax formation, the heavy petroleum fractions are also typically lightly processed (or even unprocessed) so can contain higher sulfur content. To provide the requisite sulfur levels and wax behavior, the heavy petroleum fractions can be blended with distillate flux. In some embodiments, the composition of the components of the marine fuel compositions and their relative proportions can be selected to provide a marine fuel composition having the properties enumerated herein.

Additional properties that can characterize heavy petroleum fractions, include, but are not limited to, density, KV50, carbon residue, pour point, and wax endpoint. In some embodiments, the heavy petroleum fraction may have a density in g/cm$^3$ of about 0.93 to about 1.0, for example about 0.95 to about 1, or about 0.93 to about 0.95. In some embodiments, the heavy petroleum fraction may have a KV50 in cSt ("cSt") of about 30 or greater, for example about 30 to about 2,500,000, about 30 to about 100, about 100 to about 10,000, or about 500 to about 1,000. In some embodiments, the heavy petroleum fraction may have a carbon residue in wt. % of about 1 to about 18, or about 1 to about 15, or about 1 to about 12. In some embodiments, the heavy petroleum fraction may have a pour point in degrees Celsius ("° C.") of about 0 or greater, for example about 0 to about 35, or about 0 to about 25, or about 0 to about 20, or about 0 to about 15. In some embodiments, the heavy petroleum fraction may have a wax endpoint temperature in degrees Celsius ("° C.") of about 350r greater, for example about 35 to about 130, or about 35 to about 100, or about 40 to about 90, or about 40 to about 80. In some embodiments, the heavy petroleum fraction may have a high sulfur content. For example, the heavy petroleum fraction may have a sulfur content in wt. % of greater than about 0.10, for example about 0.10 to about 5, about 0.50 to about 3, or about 1 to about 2.5. Examples of suitable heavy petroleum fractions may include a variety of different hydrocarbon fractions including, but not limited to, distillates and residues, such as heavy atmospheric gas oil, vacuum gas oil, vacuum residuals from fractionating (total/partial) crude oils, atmospheric residuals from fractionating (total/partial) crude oils, visbreaker residuals, deasphalted residuals, and slurry oil, among others. One of ordinary skill in the art, with the benefit of this disclosure, should be able to select an appropriate heavy petroleum fraction for a particular application.

Distillate fluxes have a reduced boiling point compared to the previously described heavy petroleum fraction. Additional properties that can characterize distillate fluxes include, but are not limited to, density and KV50. In some embodiments, the distillate flux may have a density in g/cm$^3$ of about 0.75 to about 1.0, for example about 0.75 to about 0.9, about 0.83 to about 0.87, or about 0.9 to about 1. In some embodiments, the distillate flux may have a KV50 in cSt of about 1 to about 30, for example about 1 to about 20, about 1 to about 10, about 1 to about 5, about 10 to about 20, or about 15 to about 20. In some embodiments, the distillate flux may have a low carbon residue such that when blended with the heavy petroleum fraction, the marine fuel composition will have a reduced carbon residue compared to the neat heavy petroleum fraction. In some embodiments the distillate flux may have a low pour point, such that when blended with the heavy petroleum fraction, the marine fuel composition will have a reduced pour point compared to the neat heavy petroleum fraction. In some embodiments, the distillate flux may have a low wax endpoint, such that when blended with the heavy petroleum fraction, the marine fuel composition will have a reduced wax endpoint temperature compared to the neat heavy petroleum fraction. In some embodiments, the distillate flux may have a low sulfur content, such that when blended with the heavy petroleum fraction, the marine fuel composition may be considered IMO 2020 compliant. For example, the distillate flux may have a sulfur content in wt. % of less than about 0.05, for example, about 0.05 to about 0.0001, about 0.1 to about 0.0001, or about 0.001 to about 0.0005. Examples of suitable distillate fluxes may include a variety of different hydrocarbon fractions including, but not limited to, light atmospheric gas oil from the atmospheric tower in fractionating (total/partial) crude oil, automotive fuel oil, hydrotreated vegetable oil (HVO) also referred to as renewable diesel, or hydrocarbon fractions from the catalytic cracker main fractionator. A specific example of a distillate flux may include diesel, such as ultra-low-sulfur diesel, which is defined by the Environmental Protection Agency to have a maximum sulfur content of 15 parts per million.

The heavier petroleum fractions and/or the distillate fluxes may be included in the marine fuel compositions in any suitable concentration, to provide the marine fuel composition with desirable properties. For example, the heavier petroleum fractions may be included in an amount of 1 vol. % to 90 vol. %, for example, about 1 vol. % to about 60 vol. %, about 1 vol. % to about 30 vol. %, about 1 vol. % to about to 10 vol. %, about 1 vol. % to about 5 vol. %, about 1 vol. % to about 3 vol. %, about 3 vol. % to about 90 vol. %, about 5 vol. % to about 90 vol. %, about 10 vol. % to about 90 vol. %, about 30 vol. % to about 90 vol. %, about 60 vol. % to about 90 vol. %, or about 80 vol. % to about 80 vol. %. By way of further example, the distillate flux may be included in an amount of 10 vol. % to 99 vol. %, for example, about 10 vol. % to about 90 vol. %, about 10 vol. % to about 60 vol. %, about 10 vol. % to about 30 vol. %, about 20 vol. % to about 99 vol. %, about 30 vol. % to about 99 vol. %, about 60 vol. % to about 99 vol. %, or about 90 vol. % to about 99 vol. %. One of ordinary skill in the art with the benefit of this disclosure should be able to select an appropriate amount of the heavier petroleum fractions and/or the distillate fluxes to include in the marine fuel compositions for a particular application.

In some embodiments, viscosity of the marine fuel compositions may be monitored to ensure compliance with viscosity requirements from the engine manufacturers. Typically, engine manufacturers will specify a viscosity range at which a marine fuel composition should be injected into the marine engine. This viscosity requirement for injection may range, for example, from about 2 cSt to about 20 cSt, regardless of temperature. For example, the engine manufacturer may specify that the marine fuel should ideally be injected at an optimal operating viscosity ranging from about 12 cSt to about 18 cSt. Some IMO 2020 compliant fuels with high concentrations of distillate flux have inherently lower viscosity and cannot be operated in the optimal viscosity range. For such fuels the lowest allowable operational viscosity at injection may be used as a guide. The lowest allowable operational viscosity at injection as specified by engine manufacturers is about 2 cSt, therefore, it is allowed but not optimal to inject a marine engine with fuel viscosity in the range of about 2 cSt to less than about 12 cSt. In some embodiments the operating viscosity is adjusted to account for precision of kinematic viscosity measurement. To meet the desired viscosity at injection, the temperature of the marine fuel composition may be modulated. For example, high viscosity marine fuel compositions may be heated to reduce the viscosity to meet the viscosity at injection, while some low viscosity marine fuel compositions may be cooled to increase the viscosity at injection.

In some embodiments, the wax behavior of the marine fuel compositions may be monitored to ensure that the fuel is essentially free of solid wax when the fuel is injected into the engine. As previously described, solid wax in the marine fuel composition can lead to filter blocking in the fuel handling system, thus potentially starving the engine of fuel. If solid wax is present in the marine fuel composition, embodiments may include increasing the temperature at which the marine fuel composition may be injected into the engine so that essentially all the wax would be melted and in the liquid phase prior to injection. However, with hydrocarbon components in the marine fuel composition that are low sulfur and low viscosity to reach the new sulfur requirements, the overall viscosity of the marine fuel composition may be low enough such that raising the temperature to reduce solid wax may result in too low of viscosity, potentially below the lowest optimal operating viscosity or below the lowest allowable operating viscosity. Such fuels, if maintained above the lowest allowable operating viscosity would plug filters, cause operational problems on a marine vessel and generally be described as having unacceptable wax behavior. Accordingly, embodiments may include using various approaches to provide a marine fuel composition with acceptable wax behavior. For example, (1) a wax endpoint of 100° C. or less measured by DSC in combination with a ratio of kinematic viscosity at 100° C. to operating viscosity greater than 1; (2) a ratio of measured or calculated kinematic viscosity at the wax endpoint to operating viscosity greater than 1; or (3) a ratio of kinematic viscosity at 50° C. to wax flow viscosity of greater than 1. For any of the approaches (1) through (3) above, the operating viscosity used for determining the ratio may be (a) the lowest optimal operating viscosity, $OV_o$, (b) the lowest optimal operating viscosity adjusted to account for test precision, $OV_{oP}$, (c) the lowest allowable operating viscosity, $OV_a$, or (d) the lowest allowable operating viscosity adjusted to account for test precision, $OV_{aP}$.

Based on the relationship between viscosity and wax behavior for embodiments of the marine fuel compositions having low sulfur content, various desirable properties for a fuel oil composition may be specified. Examples of suitable marine fuel compositions may be enumerated by the following properties: (i) a sulfur content of about 0.50 wt. % or less; (ii) a density at 15° C. of about 0.86 g/cm$^3$ to about 1.01 g/cm$^3$;(iii) a kinematic viscosity at 50° C. ("KV50") of about 1 cSt to about 700 cSt; and (iv) acceptable wax behavior, i.e. no wax-related filter plugging during operation of a marine vessel.

One property that can be used for selection and/or modification of embodiments of the marine fuel compositions is sulfur content. By way of example, the marine fuel compositions may be considered IMO 2020-compliant in that embodiments of the marine fuel oil compositions have a sulfur content of about 0.50 wt. % or less. Sulfur (in wppm or wt. %) can be determined according to ASTM D2622, ASTM D 4294, ISO 8754, or ISO 14596. Examples of suitable marine fuel compositions may have a sulfur content of about 0.0001 wt. % to about 0.50 wt. %, for example, about 0.0001 wt. % to about 0.05 wt. %, about 0.01 wt. % to about 0.1 wt. %, about 0.05 wt. % to about 0.50 wt. %, about 0.1 wt. % to about 0.3 wt. %, about 0.2 wt. % to about 0.45 wt. %, or about 0.4 wt. % to about 0.49 wt. %. Specific examples of suitable marine fuel compositions may have a sulfur content of about 0.0001 wt. %, about 0.001 wt. %, 0.005 wt. %, about 0.01 wt. %, about 0.02 wt. % about 0.03 wt. %, about 0.05 wt. %, 0.1 wt. %, about 0.2 wt. %, about 0.3 wt. %, about 0.4 wt. %, about 0.45 wt. %, about 0.49 wt. %, or about 0.50 wt. %. One of ordinary skill in the art, with the benefit of this disclosure, should be able to select an appropriate sulfur content for embodiments of the marine fuel compositions, as desired for a particular application.

The marine fuel compositions disclosed herein may be considered Emission Control Area (ECA)-compliant in that certain embodiments of the marine fuel oil compositions have a sulfur content of about 0.10 wt. % or less; and/or (2) the marine fuel compositions may be considered suitable for marine vessels equipped with emissions scrubbing equipment in that certain embodiments of the marine fuel oil compositions have a sulfur content of about 3.5 wt. % or less.

Another property that can be used for selection and/or modification of embodiments of the marine fuel compositions is density. The standardized test methods in ASTM D4052, ISO 3675, or ISO 12185 are defined as providing the procedure for determination of density. In some embodiments, a marine fuel composition may have a density at 15° C. of about 0.86 g/cm$^3$ to about 1.01 g/cm$^3$. For example, the density at 15° C. of the marine fuel composition may be about 0.86 g/cm$^3$ to about 1.0 g/cm$^3$, about 0.86 g/cm$^3$ to about 0.98 g/cm$^3$, 0.86 g/cm$^3$ to about 0.97 g/cm$^3$, about 0.86 g/cm$^3$ to about 0.93 g/cm$^3$, about 0.86 g/cm$^3$ to about 0.9 g/cm$^3$, 0.86 g/cm$^3$ to about 0.89 g/cm$^3$, about 0.9 g/cm$^3$ to about 1.01 g/cm$^3$, about 0.9 g/cm$^3$ to about 0.95 g/cm$^3$, about 0.94 g/cm$^3$ to about 1.01 g/cm$^3$, about 0.98 g/cm$^3$ to about 1.01 g/cm$^3$, or about 1.0 g/cm$^3$ to about 1.01 g/cm$^3$. Specific examples of suitable marine fuel compositions may have a density at 15° C. of about 0.86 g/cm$^3$, about 0.87 g/cm$^3$, about 0.88 g/cm$^3$, about 0.89 g/cm$^3$, about 0.9 g/cm$^3$, about 0.91 g/cm$^3$, about 0.92 g/cm$^3$, about 0.93 g/cm$^3$, about 0.94 g/cm$^3$, about 0.95 g/cm$^3$, about 0.96 g/cm$^3$, about 0.97 g/cm$^3$, about 0.98 g/cm$^3$, about 0.99 g/cm$^3$, about 1 g/cm$^3$, or about 1.01 g/cm$^3$. One of ordinary skill in the art, with the benefit of this disclosure, should be able to select an appropriate density for embodiments of the marine fuel compositions, as desired for a particular application.

Another property that can be used for selection and/or modification of embodiments of the marine fuel compositions is asphaltene content. The standardized test methods in ASTM D3279, ASTM D6560, or IP 143 are defined as providing the procedure for determination of asphaltene content. Asphaltene content may also be termed n-heptane insolubles, and these terms may be used interchangeably in the specification and the claims. In some embodiments, a marine fuel composition may have an asphaltene content of about 0.5 wt. % to about 10 wt. %, or about 0.5 wt. % to about 8 wt. %, or about 0.5 wt. % to about 6 wt. %, or about 0.5 wt. % to about 5 wt. %, or about 0.5 wt. % to about 4 wt. %, or about 0.5 wt. % to about 3 wt. %, or about 0.5 wt. % to about 2 wt. %, or about 0.8 wt. % to about 10 wt. %, or about 0.8 wt. % to about 8 wt. %, or about 0.8 wt. % to about 6 wt. %, or about 0.8 wt. % to about 5 wt. %, or about 0.8 wt. % to about 4 wt. %, or about 0.8 wt. % to about 3 wt. %, or about 1 wt. % to about 8 wt. %, or about 1 wt. % to about 5 wt. %. One of ordinary skill in the art, with the benefit of this disclosure, should be able to select an appropriate asphaltene content for embodiments of the marine fuel compositions, as desired for a particular application.

Another property that can be used for selection and/or modification of embodiments of the marine fuel compositions is carbon residue. The standardized test methods in ASTM D4530, ASTM D524, or ISO 10370 are defined as providing the procedure for determination of carbon residue. Carbon residue may also be termed micro carbon residue or Ramsbottom carbon residue, and these may be used interchangeably in the specification and the claims. In some embodiments, a marine fuel composition may have a carbon residue of about 0.5 wt. % to about 18 wt. %, or about 0.5 wt. % to about 15 wt. %, or about 0.5 wt. % to about 12 wt. %, or about 0.5 wt. % to about 10 wt. %, or about 0.5 wt. % to about 5 wt. %, or about 0.5 wt. % to about 2 wt. %, or about 1 wt. % to about 18 wt. %, or about 1 wt. % to about 15 wt. %, or about 1 wt. % to about 12 wt. %, or about 1 wt. % to about 10 wt. %, or about 1 wt. % to about 8 wt. %, or about 1 wt. % to about 5 wt. %, or about 2 wt. % to about 5 wt. %, or about 2 wt. % to about 5 wt. %, or about 2 wt. % to about 10 wt. %. One of ordinary skill in the art, with the benefit of this disclosure, should be able to select an appropriate carbon residue for embodiments of the marine fuel compositions, as desired for a particular application.

Another property that can be used for selection and/or modification of embodiments of the marine fuel compositions is T50. The standardized test methods in ASTM D86, ASTM D2887, or ASTM D7169 are defined as providing the procedure for determination of T50. In some aspects, the fuel compositions disclosed herein can have a T50 distillation point of 400° C. or more, or 450° C. or more, or 500° C. or more, or 550° C. or more, or 600° C. or more, or potentially higher. One of ordinary skill in the art, with the benefit of this disclosure, should be able to select an appropriate T50 for embodiments of the marine fuel compositions, as desired for a particular application.

Another property that can be used for selection and/or modification of embodiments of the marine fuel compositions is T90. The standardized test methods in ASTM D86, ASTM D2887, or ASTM D7169 are defined as providing the procedure for determination of T90. In some aspects, the fuel compositions disclosed herein can have a T90 distillation point of 450° C. or more, or 500° C. or more, or 550° C. or more, or 600° C. or more, or 650° C. or more, or 700° C., or 750° C. or more, or potentially higher. One of ordinary skill in the art, with the benefit of this disclosure, should be able to select an appropriate T90 for embodiments of the marine fuel compositions, as desired for a particular application.

Yet another property that can be used for selection and/or modification of embodiments of the marine fuel compositions is KV50. The standardized test methods in ASTM D445 or ISO 3104 are defined as providing the procedure for determining KV50. In some embodiments, a marine fuel composition may have a KV50 of about 5 cSt to about 700 cSt, for example, about 5 cSt to about 650 cSt, about 5 cSt to about 600 cSt, about 5 cSt to about 550 cSt, about 5 cSt to about 500 cSt, about 5 cSt to about 450 cSt, about 5 cSt to about 400 cSt, about 5 cSt to about 350 cSt, about 5 cSt to about 300 cSt, about 5 cSt to about 250 cSt, about 5 cSt to about 200 cSt, about 5 cSt to about 150 cSt, about 5 cSt to about 100 cSt, about 5 cSt to about 80 cSt, about 5 cSt to about 60 cSt, about 5 cSt to about 40 cSt, about 5 cSt to about 20 cSt, about 10 cSt to about 700 cSt, about 50 cSt to about 700 cSt, about 100 cSt to about 700 cSt, about 150 cSt to about 700 cSt, about 200 cSt to about 700 cSt, about 250 cSt to about 700 cSt, about 300 cSt to about 700 cSt, about 350 cSt to about 700 cSt, about 400 cSt to about 700 cSt, about 450 cSt to about 700 cSt, about 500 cSt to about 700 cSt, about 550 cSt to about 700 cSt, about 600 cSt to about 700 cSt, about 650 cSt to about 700 cSt. Specific examples of suitable marine fuel oil compositions may have a KV50 of about 5 cSt, about 10 cSt, about 50 cSt, about 100 cSt, about 150 cSt, about 200 cSt, about 250 cSt, about 300 cSt, about 350 cSt, about 380 cSt, about 400 cSt, about 450 cSt, about 500 cSt, about 550 cSt, about 600 cSt, about 650 cSt, or about 700 cSt. In some embodiments, the marine a marine fuel composition may have a KV50 of about 700 cSt or less, about 600 cSt or less, about 400 cSt or less, about 200 cSt or less, or about 100 cSt or less. In accordance with some embodiments, selection and/or modification of an appropriate KV50 in combination with wax flow viscosity provide an ability for the marine fuel compositions to meet viscosity requirements from engine manufacturers while also being essentially free of solid wax during injection into the engine. One of ordinary skill in the art, with the benefit of this disclosure, should be able to select an appropriate KV50 for embodiments of the marine fuel compositions, as desired for a particular application.

Yet another property that can be used for selection and/or modification of embodiments of the marine fuel compositions is the kinematic viscosity at 100° C. ("KV100"). The standardized test methods in ASTM D445 or ISO 3104 are defined as providing the procedure for determining KV100. In some embodiments, a marine fuel composition may have a KV100 of about 1 cSt to about 200 cSt, about 1 cSt to about 150 cSt, about 1 cSt to about 100 cSt, about 1 cSt to about 80 cSt, about 1 cSt to about 60 cSt, about 1 cSt to about 50 cSt, about 1 cSt to about 40 cSt, about 1 cSt to about 20 cSt, about 10 cSt to about 200 cSt, about 20 cSt to about 200 cSt, about 50 cSt to about 200 cSt, about 100 cSt to about 200 cSt, or about 150 cSt to about 200 cSt. Specific examples of suitable marine fuel oil compositions may have a KV100 of about 2 cSt, about 5 cSt, about 10 cSt, about 50 cSt, about 100 cSt, about 150 cSt, or about 200 cSt. In some embodiments, the marine a marine fuel composition may have a KV100 of about 200 cSt or less, about 100 cSt or less, about 60 cSt or less, about 10 cSt or less, or about 5 cSt or less. In accordance with some embodiments, selection and/or modification of an appropriate KV100 in combination with operating viscosity provide an ability for the marine fuel compositions to meet viscosity requirements from engine manufacturers while also being essentially free of solid wax during injection into the engine. One of ordinary skill in the art, with the benefit of this disclosure, should be able to select an appropriate KV100 for embodiments of the marine fuel compositions, as desired for a particular application.

Yet another property that can be used for selection and/or modification of embodiments of the marine fuel compositions is wax endpoint. In some embodiments, a marine fuel composition may have a wax endpoint temperature of about 35° C. to about 130° C., for example about 35° C. to about 120° C., about 35° C. to about 110° C., about 35° C. to about 100° C., about 35° C. to about 90° C., about 35° C. to about 80° C., about 35° C. to about 70° C., about 35° C. to about 60° C., about 35° C. to about 50° C., about 35° C. to about 40° C., about 40° C. to about 130° C., about 50° C. to about 130° C., about 60° C. to about 130° C., about 70° C. to about 130° C., about 80° C. to about 130° C., about 90° C. to about 130° C., about 100° C. to about 130° C., about 110° C. to about 130° C., about 120° C. to about 130° C., about 40° C. to about 120° C., about 40° C. to about 110° C., about 40° C. to about 100° C., about 40° C. to about 90° C., about 40° C. to about 80° C., about 40° C. to about 70° C., about 40° C. to about 60° C., or about 40° C. to about 50° C. Specific examples of suitable marine fuel oil compositions may have a wax endpoint temperature of about 35° C., about 40° C., about 50° C., about 60° C., about 70° C., about 80° C., about 90° C., about 100° C., about 110° C., about 120° C., or about 130° C. One of ordinary skill in the art, with the benefit of this disclosure, should be able to select an appropriate wax endpoint temperature for embodiments of the marine fuel compositions, as desired for a particular application.

Yet another property that can be used for selection and/or modification of embodiments of the marine fuel compositions is the kinematic viscosity at the wax endpoint. The standardized test methods in ASTM D445 or ISO 3104 are defined as providing the procedure for determining the kinematic viscosity at the wax endpoint experimentally, or, the kinematic viscosity at the wax endpoint can be calculated using online tools for viscosity calculation in accordance with ASTM D341, by inputting into the online tool two viscosities at two different temperatures and the wax endpoint temperature. In some embodiments, a marine fuel composition may have a kinematic viscosity at the wax endpoint of about 1 cSt to about 200 cSt, about 1 cSt to about 150 cSt, about 1 cSt to about 100 cSt, about 1 cSt to about 80 cSt, about 1 cSt to about 60 cSt, about 1 cSt to about 50 cSt, about 1 cSt to about 40 cSt, about 1 cSt to about 20 cSt, about 10 cSt to about 200 cSt, about 20 cSt to about 200 cSt, about 50 cSt to about 200 cSt, about 100 cSt to about 200 cSt, or about 150 cSt to about 200 cSt. Specific examples of suitable marine fuel oil compositions may have a kinematic viscosity at the wax endpoint of about 2 cSt, about 5 cSt, about 10 cSt, about 50 cSt, about 100 cSt, about 150 cSt, or about 200 cSt. In some embodiments, the marine fuel composition may have a kinematic viscosity at the wax endpoint of about 200 cSt or less, about 100 cSt or less, about 60 cSt or less, about 10 cSt or less, or about 5 cSt or less. In accordance with some embodiments, selection and/or modification of an appropriate kinematic viscosity at the wax endpoint in combination with operating viscosity provide an ability for the marine fuel compositions to meet viscosity requirements from engine manufacturers while also being essentially free of solid wax during injection into the engine. One of ordinary skill in the art, with the benefit of this disclosure, should be able to select an appropriate kinematic viscosity at the wax endpoint for embodiments of the marine fuel compositions, as desired for a particular application.

Yet another property that can be used for selection and/or modification of embodiments of the marine fuel compositions is operating viscosity ("OV"). The operating viscosity may be selected according to engine manufacturer recommendations. According to engine manufacturers, the lowest allowable operating viscosity for engine operation is about 2 cSt (defined herein as "$OV_a$"), and the lowest operating viscosity that will provide optimal operation is about 12 cSt (defined herein as "$OV_o$"), where between about 12 cSt to 18 cSt represents boundaries of the optimal operating viscosity range. A vessel operator is allowed to operate a marine vessel fuel handling system using an operating viscosity between about 2 cSt and less than about 12 cSt, however, this condition will not provide optimal engine operation. In some embodiments the operating viscosity is adjusted to account for precision of kinematic viscosity measurement. The method described herein is defined as providing an operating viscosity adjusted for test precision, also referred to herein as a precision-adjusted operating viscosity. The methodology by which operating viscosity may be adjusted to account for precision of kinematic viscosity measurement by ASTM D445 will now be described. To ensure that a measurement of kinematic viscosity by ASTM D445 will be above the operating viscosity with 95% confidence, an operating viscosity adjusted for precision (referred to herein as "$OV_P$") may be used for the purpose of comparing measured or calculated kinematic viscosity to operating viscosity. The $OV_P$ is defined as a kinematic viscosity value that may be reduced by the calculated test reproducibility (R) for an ASTM D445 kinematic viscosity measurement at 100° C. and result in a value greater than the non-adjusted, manufacturer recommended operating viscosity, also shown in the equation below. More specifically the manufacturer-recommended lowest allowable operating viscosity $OV_a$ and the manufacturer-recommended lowest optimal operating viscosity $OV_o$ may be adjusted for test precision to result precision adjusted values $OV_{aP}$ and $OV_{oP}$ respectively, which are also described in the equations below.

$$OV_P - R > OV$$

$$OV_{aP} - R > OV_a$$

$$OV_{oP} - R > OV_o$$

For an $OV_a$ of 2.000 cSt, the $OV_{aP}$ value of 2.275 cSt was determined to meet the requirements of the equation shown above. $OV_{aP}$ was calculated according to the relationship $OV_{aP}-R>OV_a$ where $OV_a$ is the manufacturer-recommended lowest allowable operating viscosity, 2.000 cSt, and R is the calculated test reproducibility (R) for an ASTM D445 kinematic viscosity measurement at 100° C. Per the ASTM D445 method, R is equal to 0.1206×, where x is the average of two results being compared, and for the purpose of this calculation x is equal to the $OV_a$ value. An $OV_{aP}$ value of 2.275 cSt was determined to satisfy this relationship:

$$OV_{aP} - R > OV_a \quad (1)$$

$$R = 0.1206 \times OV_a = 0.1206 \times 2.000cSt = 0.2744cSt \quad (2)$$

$$OV_{aP} - 0.2744cSt > 2.000cSt \quad (3)$$

$$2.275cSt - 0.2744cSt = 2.001cSt, \text{ which satisfies(3)} \quad (4)$$

For an $OV_o$ of 12.000 cSt, the $OV_{oP}$ value of 13.65 cSt was determined to meet the requirements of the equation shown above. $OV_{oP}$ can be calculated according to the relationship $OV_{oP}$— $R>OV_o$ where $OV_o$ is the manufacturer-recommended lowest optimal operating viscosity, 12.00 cSt, and R is the calculated test reproducibility (R) for an ASTM D445 kinematic viscosity measurement at 100° C. Per the ASTM D445 method, R is equal to 0.1206×, where x is the average of two results being compared, and for the purpose of this calculation x is equal to the $OV_o$ value. An $OV_{oP}$ value of 13.65 cSt was determined to satisfy this relationship:

$$OV_{oP} - R > OV_o \quad (1)$$

$$R = 0.1206 \times OV_o = 0.1206 \times 12.00cSt = 1.646cSt \quad (2)$$

$$OV_{oP} - 1.646cSt > 12.00cSt \quad (3)$$

$$13.65cSt - 1.646cSt = 12.004cSt, \text{ which satisfies(3)} \quad (4)$$

One of ordinary skill in the art, with the benefit of this disclosure, should be able to select an appropriate operating viscosity or precision-adjusted operating viscosity for embodiments of the marine fuel compositions, as desired for a particular application.

Yet another property that can be used for selection and/or modification of embodiments of the marine fuel compositions is ratio of kinematic viscosity at 100° C. to the operating viscosity. It has been determined that, for marine fuel compositions with wax endpoint≤100° C., there is a relationship between kinematic viscosity at 100° C. to the operating viscosity. In accordance with certain embodiments, marine fuel compositions with acceptable wax behavior have a kinematic viscosity at 100° C. that is greater than the operating viscosity. By way of example, if the kinematic viscosity at 100° C. of the marine fuel composition is greater than the operating viscosity, then essentially all the wax should be melted at injection temperature. In other words, essentially all the wax in the marine fuel composition should be in a liquid state as it is being injected into the engine, thus reducing problems caused by solid wax blocking the fuel filters. In some embodiments, a marine fuel composition may have a ratio of kinematic viscosity at 100° C. to operating viscosity greater than 1. By way of example, the marine fuel composition may have a ratio of kinematic viscosity at 100° C. to operating viscosity of about 1.01 to about 50, for example, about 1.1 to about 50, about 2 to about 50, about 5 to about 50, about 10 to about 50, about 15 to about 50, about 20 to about 50, about 30 to about 50, about 40 to about 50, about 1.01 to about 45, about 1.01 to about 40, about 1.01 to about 30 about 1.01 to about 20, about 1.01 to about 15, about 1.01 to about 10, about 1.01 to about 5, about 1.01 to about 2, about 2 to about 50, about 2 to about 40, about 2 to about 30, about 2 to about 20, about 2 to about 10, about 5 to about 40, about 5 to about 30, about 5 to about 10, about 10 to about 30, or about 10 to about 20. Specific examples of suitable marine fuel compositions may have a ratio of kinematic viscosity at 100° C. to operating viscosity of about 1.01, about 1.5, about 2, about 2.5, about 3, about 4, about 5, about 10, about 15, about 20, about 30, about 40, or about 50. In accordance with some embodiments, selection and/or modification of the ratio of kinematic viscosity at 100° C. to operating viscosity can provide an ability for the marine fuel compositions to meet viscosity requirements from engine manufacturers while also being essentially free of solid wax during injection into the engine, and the marine fuel composition is considered to have acceptable wax behavior. One of ordinary skill in the art, with the benefit of this disclosure, should be able to select a ratio of kinematic viscosity at 100° C. to operating viscosity for embodiments of the marine fuel compositions, as desired for a particular application.

Figure 2:
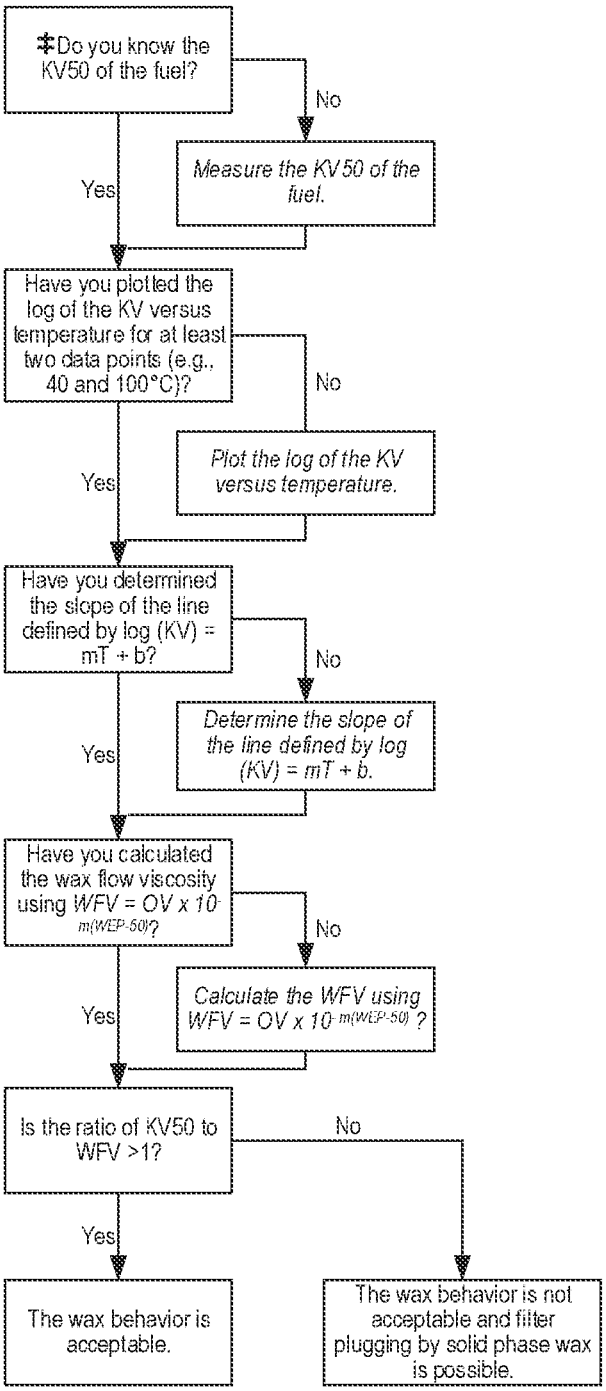
FIG. 2 illustrates a flow chart describing an approach to determine wax behavior of a marine fuel composition using a calculated wax flow viscosity.

A technique for determining the ratio of the kinematic viscosity at 100° C. to the operating viscosity will now be described. The technique is also summarized in flow chart form in FIG. 1 The method described herein is defined as providing the ratio of the kinematic viscosity at 100° C. to the operating viscosity. The method includes measuring a wax endpoint temperature for a marine fuel composition, determining that the wax endpoint temperature is less than 100° C., measuring kinematic viscosity of the marine fuel composition at 100° C. ("KV100"), identifying an operational viscosity for use of the marine fuel composition, which may be the lowest operating viscosity or the lowest optimal viscosity required by the engine manufacturer, with or without adjusting for precision, and if the ratio of the kinematic viscosity at 100° C. to the operating viscosity is less than or equal to 1, either (a) rejecting the marine fuel composition, or proceeding to evaluate the marine fuel composition by an alternative technique, such as (b) determining the ratio of the kinematic viscosity at the wax endpoint temperature to the operating viscosity, as shown in FIG. 1, or (c) determining the ratio of the KV50 to the wax flow viscosity, as shown in FIG. 2. Should this ratio of the kinematic viscosity at 100° C. to the operating viscosity of the marine fuel composition be greater than 1, then the marine fuel composition may have an acceptable wax behavior, indicating that essentially all the wax will be melted during injection into the engine while having an allowable kinematic viscosity.

Figure 3:
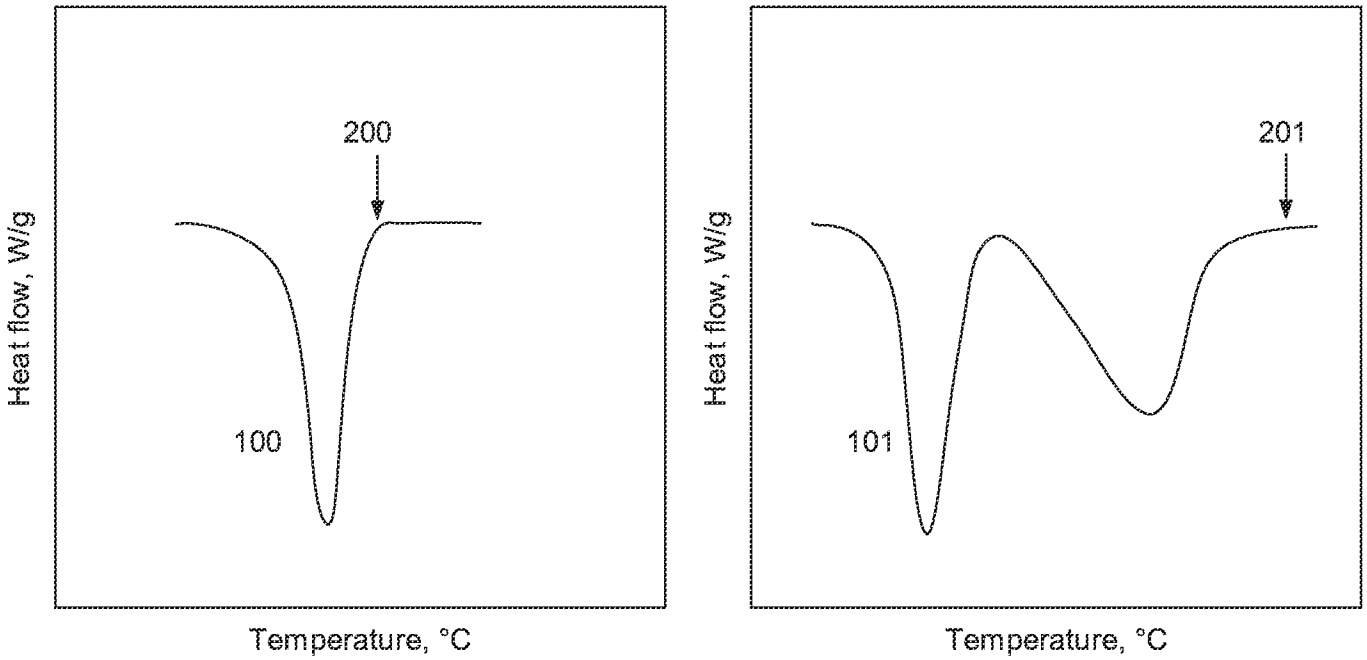
FIG. 3 illustrates a prophetic graph of temperature versus heat flow for two different marine fuel compositions.

In determining the ratio of the kinematic viscosity at 100° C. to the operating viscosity, the method includes determining a wax endpoint temperature. Determining the wax endpoint can include measuring the temperature profile of the marine fuel composition. By way of example, the temperature profile may be measured using differential scanning calorimetry ("DSC") in which the difference in the amount of heat required to increase the temperature of a sample is measured as a function of temperature. The DSC may be performed, for example, in accordance with any suitable technique, including, but not limited to, ASTM D4419-90 (2015). In some embodiments, the wax endpoint point may be determined based on the DSC. Embodiments may use a heat flow or a heat flux DSC. The heat flow or heat flux determined from the DSC may be provided as function of temperature. FIG. 3 is an illustrative plot of heat flow as a function of temperature for a heat flow DSC. In FIG. 3, the heat flow is plotted as a function of temperature, shown as curves 100 and 101. The point where curve 100 or 101 reaches an asymptote and returns to the baseline is the wax endpoint temperature. On FIG. 3, the wax endpoint temperature is at point 200 or 201. After it is determined, the wax endpoint temperature is then compared to the maximum wax endpoint temperature limit of 100° C. Should the wax endpoint temperature of the marine fuel composition be less than 100° C., then the method of calculating the ratio of the kinematic viscosity at 100° C. to the operating viscosity can be used to determine whether a marine fuel composition has acceptable wax behavior (i.e. ratio of kinematic viscosity at 100° C. to the operating viscosity greater than 1). Should the wax endpoint temperature of the marine fuel composition be greater than 100° C., then the method of taking the ratio of the kinematic viscosity at 100° C. to the operating viscosity should not be used to determine whether a marine fuel composition has acceptable wax behavior (i.e. ratio of kinematic viscosity at 100° C. to the operating viscosity greater than 1), and instead, the method of using a ratio of the measured or calculated kinematic viscosity at the wax endpoint temperature to the operating viscosity is appropriate, or the method of calculating a wax flow viscosity and comparing the measured KV50 to the wax flow viscosity is appropriate. These methods are described later in this document.

In determining ratio of the kinematic viscosity at 100° C. to the operating viscosity, the method includes identifying an operating viscosity. In some embodiments, the operating viscosity may be selected from operating viscosity values specifically recommended by engine manufacturers. According to engine manufacturers, the lowest allowable operating viscosity for engine operation is about 2 cSt (defined herein as "$OV_a$"), and the lowest operating viscosity that will provide optimal operation is about 12 cSt (defined herein as "$OV_o$"). In some embodiments, the manufacturer-recommended lowest allowable operating viscosity $OV_a$ or the manufacturer-recommended lowest optimal operating viscosity $OV_o$ may be adjusted for test precision to result precision adjusted values $OV_{aP}$ and $OV_{oP}$, respectively, as described in a previous section.

After it is determined, for example using method ASTM D445, the kinematic viscosity at 100° C. is then compared to the operating viscosity. Should the kinematic viscosity at 100° C. of the marine fuel composition be greater than the operating viscosity (i.e., a ratio of kinematic viscosity at 100° C. to operating viscosity of greater than 1), then the marine fuel composition may have an acceptable wax behavior, indicating that essentially all the wax will be melted during injection into the engine while having an allowable kinematic viscosity. However, should this ratio of kinematic viscosity at 100° C. to operating viscosity be less than or equal to 1, either (a) reject the marine fuel composition, or proceed to evaluate the marine fuel composition by an alternative technique, such as (b) determining the ratio of the kinematic viscosity at the wax endpoint temperature to the operating viscosity, shown in FIG. 1, or (c) determining the ratio of the KV50 to the wax flow viscosity, as shown in FIG. 2. If a fuel composition is rejected, remedial steps may be taken to adjust the kinematic viscosity at 100° C. to provide a ratio of kinematic viscosity at 100° C. to operating viscosity greater than 1, and thereby, acceptable wax behavior. For example, the fuel composition may be re-blended, wherein concentration of one or more components in the marine fuel composition may be adjusted. Alternatively, the fuel composition may be re-blended wherein one or more additional hydrocarbon components may be added to the marine fuel composition.

Yet another property that can be used for selection and/or modification of embodiments of the marine fuel compositions is a ratio of the kinematic viscosity at the wax endpoint temperature to the operating viscosity. It has been determined that for marine fuel compositions there is a relationship between kinematic viscosity at the wax endpoint temperature to the operating viscosity. In accordance with certain embodiments, marine fuel compositions with an acceptable wax behavior have a kinematic viscosity at the wax endpoint temperature that is greater than the operating viscosity. By way of example, if the kinematic viscosity at the wax endpoint temperature of the marine fuel composition is greater than the operating viscosity, then essentially all the wax should be melted at injection temperature. In other words, essentially all the wax in the marine fuel composition should be in a liquid state as it is being injected into the engine, thus reducing problems caused by solid wax blocking the fuel filters. In some embodiments, a marine fuel composition may have a ratio of kinematic viscosity at the wax endpoint to operating viscosity greater than 1. By way of example, the marine fuel composition may have a ratio of kinematic viscosity at wax endpoint to operating viscosity of about 1.01 to about 50, for example, about 1.1 to about 50, about 2 to about 50, about 5 to about 50, about 10 to about 50, about 15 to about 50, about 20 to about 50, about 30 to about 50, about 40 to about 50, about 1.01 to about 45, about 1.01 to about 40, about 1.01 to about 30 about 1.01 to about 20, about 1.01 to about 15, about 1.01 to about 10, about 1.01 to about 5, about 1.01 to about 2, about 2 to about 50, about 2 to about 40, about 2 to about 30, about 2 to about 20, about 2 to about 10, about 5 to about 40, about 5 to about 30, about 5 to about 10, about 10 to about 30, or about 10 to about 20. Specific examples of suitable marine fuel compositions may have a ratio of kinematic viscosity at wax endpoint to operating viscosity of about 1.01, about 1.5, about 2, about 2.5, about 3, about 4, about 5, about 10, about 15, about 20, about 30, about 40, or about 50. In accordance with some embodiments, selection and/or modification of the ratio of kinematic viscosity at wax endpoint to operating viscosity can provide an ability for the marine fuel compositions to meet viscosity requirements from engine manufacturers while also being essentially free of solid wax during injection into the engine. Such marine fuel compositions are said to have acceptable wax behavior. One of ordinary skill in the art, with the benefit of this disclosure, should be able to select a ratio of kinematic viscosity at wax endpoint to operating viscosity for embodiments of the marine fuel compositions, as desired for a particular application.

A technique for determining the ratio of the kinematic viscosity at the wax endpoint temperature to the operating viscosity will now be described. The technique is also summarized in flow chart form in FIG. 1. The method described herein is defined as providing the ratio of the kinematic viscosity at the wax endpoint temperature to the operating viscosity. The method includes measuring a wax endpoint temperature for a marine fuel composition, measuring kinematic viscosity of the marine fuel composition at two temperatures, calculating the kinematic viscosity of the marine fuel composition at the wax endpoint temperature according to the method ASTM D341, identifying an operational viscosity for use of the marine fuel composition, which may be the lowest allowable operating viscosity or the lowest optimal viscosity required by the engine manufacturer, and if the ratio of the calculated kinematic viscosity at the wax endpoint temperature to the operating viscosity is less than or equal to 1, either (a) rejecting the marine fuel composition, or proceeding to evaluate the marine fuel composition by an alternative technique, such as (b) determining the ratio of the KV50 to the wax flow viscosity, as shown in FIG. 2. Should this ratio of the calculated kinematic viscosity at the wax endpoint temperature to the operating viscosity of the marine fuel composition be equal to or greater than 1, then the marine fuel composition may have an acceptable wax behavior, indicating that essentially all the wax will be melted during injection into the engine while having an allowable kinematic viscosity.

In determining the ratio of the calculated kinematic viscosity at the wax endpoint temperature to the operating viscosity, the method includes determining a wax endpoint temperature. Determining the wax endpoint can include measuring the temperature profile of the marine fuel composition. By way of example, the temperature profile may be measured using differential scanning calorimetry ("DSC") in which the difference in the amount of heat required to increase the temperature of a sample is measured as a function of temperature. The DSC may be performed, for example, in accordance with any suitable technique, including, but not limited to, ASTM D4419-90 (2015). In some embodiments, the wax endpoint point may be determined based on the DSC. Embodiments may use a heat flow or a heat flux DSC. The heat flow or heat flux determined from the DSC may be provided as function of temperature. FIG. 3 is an illustrative plot of heat flow as a function of temperature for a heat flow DSC. In FIG. 3, the heat flow is plotted as a function of temperature, shown as curves 100 and 101. The point where curve 100 or 101 reaches an asymptote and returns to the baseline is the wax endpoint temperature. On FIG. 3, the wax endpoint temperature is at point 200 or 201.

In determining ratio of the calculated kinematic viscosity at the wax endpoint temperature to the operating viscosity, the method includes identifying an operational viscosity. In some embodiments, the operating viscosity may be selected from operating viscosity values specifically recommended by engine manufacturers. According to engine manufacturers, the lowest allowable operating viscosity for engine operation is about 2 cSt (defined herein as "$OV_a$"), and the lowest operating viscosity that will provide optimal operation is about 12 cSt (defined herein as "$OV_o$"). In some embodiments, the manufacturer-recommended lowest allowable operating viscosity $OV_a$ or the manufacturer-recommended lowest optimal operating viscosity $OV_o$ may be adjusted for test precision to result precision adjusted values $OV_{aP}$ and $OV_{oP}$, respectively, as described in a previous section.

In determining the ratio of the calculated kinematic viscosity at the wax endpoint temperature to the operating viscosity, the method includes determining a measured or calculated kinematic viscosity at the wax endpoint temperature. Determining the calculated kinematic viscosity at the wax endpoint temperature can include: measuring the kinematic viscosity at two temperatures, preferably at 40° C. and at 100° C. or at 50° C. and at 100° C., measuring the wax endpoint temperature by DSC as previously described, and using the ASTM D341 method to calculate the kinematic viscosity at the wax endpoint. The ASTM D341 method includes equations to solve for (calculate) a kinematic viscosity at a specified temperature, using as inputs two kinematic viscosity measurements at two different temperatures. Solving for viscosity using the ASTM D341 method can be readily accomplished using online tools for viscosity calculation in accordance with ASTM D341, such as online tools found at the websites https://www.paragon-sci.com/D341 or https://wiki.anton-paar.com/us-en/astm-d341-viscosity-temperature-extrapolation/. By inputting into the online tool two viscosities at two different temperatures, preferably 40° C. and 100° C., or 50° C. and 100° C., and the wax endpoint temperature by DSC, the online tool provides a calculation of the kinematic viscosity at the wax endpoint temperature. In some embodiments, one skilled in the art may choose to calculate kinematic viscosity at the wax endpoint temperature using any other appropriate methodology, for example by calculation using the linear relationship between log of kinematic viscosity and temperature (log KV–temperature chart), or another suitable approach, or experimentally measure the kinematic viscosity of a fuel composition at the wax endpoint temperature using ASTM D445 or a similar test method.

After it is determined, the kinematic viscosity at the wax endpoint temperature is then compared to the operating viscosity. Should the kinematic viscosity at the wax endpoint temperature of the marine fuel composition be greater than the operating viscosity (i.e., a ratio of kinematic viscosity at the wax endpoint temperature to operating viscosity of greater than 1), then the marine fuel composition may have an acceptable wax behavior, indicating that essentially all the wax will be melted during injection into the engine while having an allowable kinematic viscosity. However, should this ratio of kinematic viscosity at the wax endpoint temperature to operating viscosity be less than or equal to 1, then either (a) the marine fuel composition may be rejected, or (b) the marine fuel composition may be evaluated by an alternative technique, such as determining the ratio of the KV50 to the wax flow viscosity, as shown in FIG. 2. If a fuel composition is rejected, remedial steps may be taken to adjust the kinematic viscosity at the wax endpoint temperature to provide a ratio of kinematic viscosity at the wax endpoint temperature to operating viscosity greater than 1, and thereby, acceptable wax behavior. For example, the fuel composition may be re-blended, wherein concentration of one or more components in the marine fuel composition may be adjusted. Alternatively, the fuel composition may be re-blended wherein one or more additional hydrocarbon components may be added to the marine fuel composition.

Yet another property that can be used for selection and/or modification of embodiments of the marine fuel compositions is ratio of KV50 to wax flow viscosity. It has been determined that there is a relationship between wax flow viscosity and KV50. In accordance with certain embodiments, marine fuel compositions with an acceptable wax behavior have a KV50 that is greater than the wax flow viscosity. By way of example, if the KV50 of the marine fuel composition is greater than the wax flow viscosity, then essentially all the wax should be melted at injection temperature. In other words, essentially all the wax in the marine fuel composition should be in a liquid state as it is being injected into the engine, thus reducing problems caused by solid wax blocking the fuel filters. In some embodiments, a marine fuel composition may have a ratio of KV50 to wax flow viscosity greater than 1. By way of example, the marine fuel composition may have a ratio of KV50 to wax flow viscosity of about 1.01 to about 50, for example, about 1.1 to about 50, about 2 to about 50, about 5 to about 50, about 10 to about 50, about 15 to about 50, about 20 to about 50, about 30 to about 50, about 40 to about 50, about 1.01 to about 45, about 1.01 to about 40, about 1.01 to about 30 about 1.01 to about 20, about 1.01 to about 15, about 1.01 to about 10, about 1.01 to about 5, about 1.01 to about 2, about 2 to about 50, about 2 to about 40, about 2 to about 30, about 2 to about 20, about 2 to about 10, about 5 to about 40, about 5 to about 30, about 5 to about 10, about 10 to about 30, or about 10 to about 20. Specific examples of suitable marine fuel compositions may have a ratio of KV50 to wax flow viscosity of about 1.01, about 1.5, about 2, about 2.5, about 3, about 4, about 5, about 10, about 15, about 20, about 30, about 40, or about 50. In accordance with some embodiments, selection and/or modification of the ratio of KV50 to wax flow viscosity can provide an ability for the marine fuel compositions to meet viscosity requirements from engine manufacturers while also being essentially free of solid wax during injection into the engine. One of ordinary skill in the art, with the benefit of this disclosure, should be able to select a ratio of KV50 to wax flow viscosity for embodiments of the marine fuel compositions, as desired for a particular application.

As previously described, the wax flow viscosity of a marine fuel composition is the minimum kinematic viscosity at about 50° C. necessary to ensure that essentially all the wax is melted prior to fuel injection at a minimum operational viscosity as specified by an engine manufacturer. Engine manufacturers may specify different viscosity ranges at which a marine fuel composition should be injected into the marine engine. This viscosity requirement for injection may range, for example, from about 2 cSt to about 20 cSt, regardless of temperature. As previously described, according to engine manufacturers, the lowest allowable operating viscosity for engine operation is about 2 cSt (defined herein as "$OV_a$"), and the lowest operating viscosity that will provide optimal operation is about 12 cSt (defined herein as "$OV_o$").

A technique for determining wax flow viscosity will now be described. The technique is also summarized in flow chart form in FIG. 2. The method described herein is defined as providing the procedure for determining wax flow viscosity. The method includes determining a wax endpoint temperature for a marine fuel composition, identifying an operational viscosity for use of the marine fuel composition, which may be the lowest allowable viscosity or the lowest optimal viscosity required by the engine manufacturer, converting the operational viscosity at the wax endpoint temperature to a viscosity at 50° C., which is the wax flow viscosity; and rejecting the marine fuel composition if the ratio of the measured KV50 of the marine fuel composition to wax flow viscosity is less than or equal to 1. Should this ratio of the measured KV50 to the wax flow viscosity of the marine fuel composition be equal to or greater than 1, then the marine fuel composition may have an acceptable wax behavior, indicating that essentially all the wax will be melted during injection into the engine while having an allowable kinematic viscosity.

In determining the wax flow viscosity, the method includes determining a wax endpoint temperature. Determining the wax endpoint can include measuring the temperature profile of the marine fuel composition. By way of example, the temperature profile may be measured using differential scanning calorimetry ("DSC") in which the difference in the amount of heat required to increase the temperature of a sample is measured as a function of temperature. The DSC may be performed, for example, in accordance with any suitable technique, including, but not limited to, ASTM D4419-90 (2015). In some embodiments, the wax endpoint point may be determined based on the DSC. Embodiments may use a heat flow or a heat flux DSC. The heat flow or heat flux determined from the DSC may be provided as function of temperature. FIG. 3 is an illustrative plot of heat flow as a function of temperature for a heat flow DSC. In FIG. 3, the heat flow is plotted as a function of temperature, shown as curves 100 and 101. The point where curve 100 or 101 reaches an asymptote and returns to the baseline is the wax endpoint temperature. On FIG. 3, the wax endpoint temperature is at point 200 or 201.

In determining wax flow viscosity, the method includes identifying an operational viscosity required by the engine manufacturer. As previously described, engine manufacturers may specify different viscosity ranges at which a marine fuel composition should be injected into the marine engine. This viscosity requirement for injection may range, for example, from about 2 cSt to about 20 cSt, regardless of temperature For example, the engine manufacturer may specify that the marine fuel should ideally be injected at an optimal operating viscosity of about 12 cSt to about 18 cSt, thus providing a lowest optimal kinematic viscosity at injection of 12 cSt. Some IMO 2020 compliant fuels with high concentrations of distillate flux have inherently lower viscosity and cannot be operated in the optimal operating viscosity range. For such fuels the lowest allowable operating viscosity may be used as a guide. The lowest allowable operating viscosity specified by engine manufacturers is about 2 cSt. Therefore, it is acceptable but not optimal to operate a marine engine with fuel viscosity at injection in the range of about 2 cSt to less than about 12 cSt. Operating a marine engine with fuel viscosity at the point of injection of less than about 2 cSt would result in poor engine operation and should not be practiced, per engine manufacturers.

Figure 4:
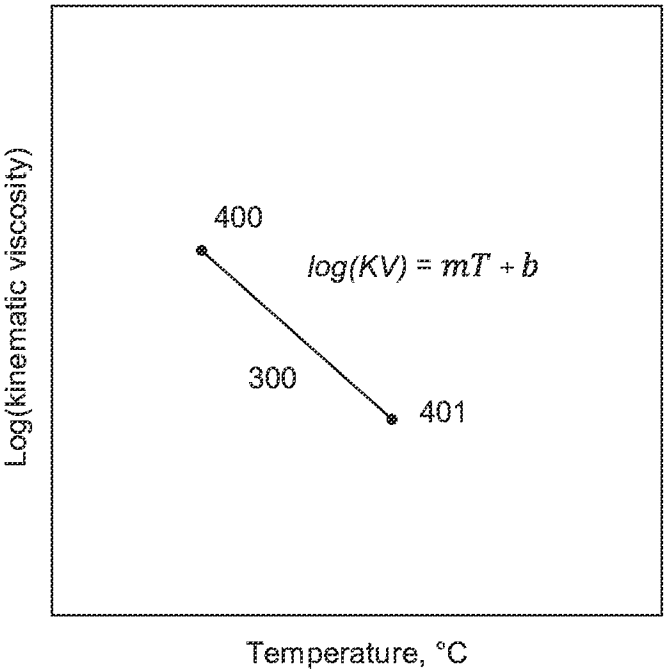
FIG. 4 illustrates a prophetic graph of the log of the kinematic viscosity versus temperature for a marine fuel composition.

Next, the viscosity-temperature relationship of the marine fuel composition must be defined. The kinematic viscosity of the marine fuel composition must be measured at two or more different temperatures, preferably 40° C. and 100° C., 50° C. and 100° C., or 40° C. and 50° C. and 100° C. The log of the kinematic viscosity measurements are plotted versus temperature (FIG. 4, Points 400 and 401, illustrating measurements at two different temperatures). Using the log of the measured kinematic viscosities and the test temperatures, a line can be drawn (FIG. 4, curve 300). The equation that describes this line is log(KV)=mT+b, where KV is the measured kinematic viscosity in cSt and T is the kinematic viscosity measurement temperature in ° C. The slope (m) of this line describes the relationship between the log of the kinematic viscosity and temperature for a particular marine fuel composition.

To complete the determination of wax flow viscosity, the wax flow viscosity is calculated from the wax endpoint temperature, operational viscosity, and the slope that defines the viscosity-temperature relationship for the marine fuel composition. This wax flow viscosity may be calculated by taking the log of the operational viscosity, subtracting the slope multiplied by the difference in the wax endpoint temperature and 50° C. The equation describing this transformation is $$WFV=OV\times10^{-m(WEP-50)}$$

where m=slope of the line defined by the log of the measured kinematic viscosity versus temperature for a particular marine fuel composition WFV=wax flow viscosity OV=operational viscosity, which may be the lowest allowable operational viscosity $OV_a$ or the lowest optimal operating viscosity $OV_o$ WEP=wax endpoint The measured kinematic viscosity at 50° C. is then compared to wax flow viscosity. Should the measured kinematic viscosity at 50° C. of the marine fuel composition be greater than the wax flow viscosity (i.e., a ratio of measured kinematic viscosity at 50° C. to wax flow viscosity of greater than 1), then the marine fuel composition may have an acceptable wax behavior, indicating that essentially all the wax will be melted during injection into the engine while having an allowable kinematic viscosity. However, should this ratio of measured kinematic viscosity at 50° C. to wax flow viscosity be less than or equal to 1, the marine fuel composition will have unacceptable wax behavior and may be rejected. Remedial steps may be taken to adjust the wax flow viscosity to provide an acceptable wax behavior. For example, the fuel composition may be re-blended, wherein concentration of one or more components in the marine fuel composition may be adjusted. Alternatively, the fuel composition may be re-blended wherein one or more additional hydrocarbon components may be added to the marine fuel composition.

As described above, there are three methodologies to evaluate wax behavior of fuel compositions: (1) measuring a fuel kinematic viscosity at 100° C., dividing the fuel kinematic viscosity at 100° C. by the operating viscosity to generate a ratio, and determining if the ratio is greater than or less than or equal to 1, and either rejecting or re-blending a fuel if it is less than or equal to 1, or proceeding to re-evaluate by one of the following approaches (2) or (3); (2) measuring a fuel kinematic viscosity at two or more temperatures, such as 40° C. and 100° C., and calculating a marine fuel viscosity at the wax endpoint according to ASTM D341, dividing the fuel kinematic viscosity at the wax endpoint by the operating viscosity to generate a ratio, and determining if the ratio is greater than or less than or equal to 1, and rejecting or re-blending a fuel if it is less than or equal to 1, or proceeding to re-evaluate by approach (3); (3) measuring a fuel kinematic viscosity at two temperatures, such as 40° C. and 100° C., and converting the operational viscosity at the wax endpoint temperature to a calculated kinematic viscosity at 50° C. to define a wax flow viscosity, and then dividing the measured kinematic viscosity at 50° C. by the wax flow viscosity to generate a ratio, determining if the ratio is greater than or less than or equal to 1, and rejecting or re-blending a fuel if it is less than or equal to 1. The methodologies to determine wax behavior by approaches (1) through (3) are summarized in flow chart form in FIG. 1 and FIG. 2. Approach (1) is a simplified methodology that requires the least amount of data points to complete, approach (2) requires additional data points compared to approach (1), and approach (3) requires the most amount of data on a given fuel composition to complete. While approaches requiring less data, particularly approach (1), may be faster or more convenient to implement, in some cases they can inaccurately identify a fuel composition as having unacceptable wax behavior, and where desired, the results may be validated by generating additional data and evaluating a fuel composition by approaches (2) and/or (3). One of ordinary skill in the art, with the benefit of this disclosure, should be able to select an appropriate approach or approaches among (1) through (3) for embodiments of the marine fuel compositions, as desired for a particular application.

Definitions

All numerical values within the detailed description and the claims herein are modified by "about" or "approximately" the indicated value, and take into account experimental error and variations that would be expected by a person having ordinary skill in the art.

"Major amount" as it relates to components included within the fuel compositions of the specification and the claims means greater than or equal to 50 wt. %, or greater than or equal to 60 wt. %, or greater than or equal to 70 wt. %, or greater than or equal to 80 wt. %, or greater than or equal to 90 wt. % based on the total weight of the fuel.

"Minor amount" as it relates to components included within the fuel compositions of the specification and the claims means less than 50 wt. %, or less than or equal to 40 wt. %, or less than or equal to 30 wt. %, or greater than or equal to 20 wt. %, or less than or equal to 10 wt. %, or less than or equal to 5 wt. %, or less than or equal to 2 wt. %, or less than or equal to 1 wt. %, based on the total weight of the fuel.

A distillate boiling range fraction is defined as a hydrocarbon fraction having a T10 distillation point of 140° C. or more and a T90 distillation point of 565° C. or less. A distillate boiling range fraction may be further defined as a hydrocarbon fraction in which at least 50 vol. % boils at about 200° C. to about 550° C. (as measured by ASTM D 86-18) at atmospheric pressure, for example, about 200° C. to about 400° C. or about 200° C. to about 350° C. Boiling ranges in weight percent may also be determined using the measurement technique described in ASTM D2887-18.

A vacuum gas oil boiling range fraction (also referred to as a heavy distillate) can have a T10 distillation point of 350° C. or higher and a T90 distillation point of 535° C. or less.

Unless otherwise specified, for resid-containing heavy petroleum fractions, distillation points and boiling points can be determined according to ASTM D7169-18. Boiling ranges in weight percent may also be determined using the measurement techniques described in ASTM D2887-18 or ASTM D6352-1. For other fractions, distillation points and boiling points can be determined according to ASTM D2887-18, but for samples that are not susceptible to characterization using ASTM D2887-18, ASTM D7169-18 can be used.

A heavy petroleum fraction, also called heavy fraction or resid-containing fraction, is defined as a fraction that includes bottoms, and therefore can contain materials including but not limited to: a vacuum resid (also referred to as vacuum tower bottoms) and/or an atmospheric resid (also referred to as atmospheric tower bottoms), main column bottoms (also referred to as cat slurry or FCC bottoms), steam cracker tar, visbreaker tar, any residue material derived from low sulfur crude slates, LSFO, RSFO, or other LSFO/RSFO blend stocks, as well as any of the above materials that have undergone hydroprocessing to reduce sulfur content. Heavy petroleum fractions may be further defined as a hydrocarbon fraction in which at least 50 vol. % boils at about 500° C. to about 750° C. (as measured by ASTM D86-18) at atmospheric pressure, for example, about 550° C. to about 650° C. or about 575° C. to about 625° C. A vacuum resid may be further defined as a bottoms fraction having a T10 distillation point of 400° C. or higher. An atmospheric resid may be further defined as a bottoms fraction having a T10 distillation point of 149° C. or higher, or 350° C. or higher. In some aspects, an atmospheric resid can have a T90 distillation point of 550° C. or more, or 565° C. or more. A resid-containing fraction may additionally contain distillate flux to improve handling characteristics that facilitate movement and blending in a petroleum refinery. Such a resid-containing fraction containing distillate flux may be referred to as a "fluxed resid fraction." Resid-containing fraction and fluxed resid fraction may be used interchangeably in the specification and the claims. It is noted that the definitions for distillate boiling range fraction, atmospheric resid, and vacuum resid are based on boiling point only. Thus, a distillate boiling range fraction or a resid-containing fraction (such as an atmospheric resid-containing fraction or a vacuum resid-containing fraction) can include components that did not pass through a distillation tower or other separation stage based on boiling point. A shale oil distillate boiling range fraction is defined as a shale oil fraction corresponding to the distillate boiling range. A shale oil atmospheric resid is defined as a shale oil bottoms fraction corresponding to an atmospheric resid. A shale oil vacuum resid is defined as a shale oil bottoms fraction corresponding to a vacuum resid.

With regard to characterizing properties of resid boiling range fractions and/or blends of such fractions with other components to form resid boiling range fuels, a variety of methods can be used. Density of a blend at 15° C. (kg/m$^3$) can be determined according ASTM D4052, ISO 3675, or ISO 12185. Sulfur (in wppm or wt. %) can be determined according to ASTM D2622, ASTM D4294, ISO 8754, or ISO 14596, while nitrogen (in wppm or wt. %) can be determined according to D5291. Kinematic viscosity at 40° C., 50° C., and/or 100° C. can be determined according to ASTM D445 or ISO 3104. Pour point can be determined according to ASTM D97 or ISO 3016. Micro Carbon Residue (MCR) content can be determined according to ASTM D4530 or ISO 10370.

In this discussion, "renewable blending components" can correspond to renewable distillate and/or vacuum gas oil and/or heavy fractions that are renewable based on one or more attributes. Some renewable blending components can correspond to components that are renewable based on being of biological origin. Examples of renewable blending components of biological origin can include, but are not limited to, fatty acid methyl esters (FAME), fatty acid alkyl esters, biodiesel, biomethanol, biologically derived dimethyl ether, oxymethylene ether, liquid derived from biomass, pyrolysis products from pyrolysis of biomass, products from gasification of biomass, and hydrotreated vegetable oil. Other renewable blending components can correspond to components that are renewable based on being extracted from a reservoir using renewable energy, such as petroleum extracted from a reservoir using an extraction method that is powered by renewable energy, such as electricity generated by solar, wind, or hydroelectric power. Still other renewable blending components can correspond to blending components that are made or processed using renewable energy, such as Fischer-Tropsch distillate that is formed using processes that are powered by renewable energy, or conventional petroleum distillate that is hydroprocessed/otherwise refinery processed using reactors that are powered by renewable energy. Yet other renewable blending components can correspond to fuel blending components formed from recycling and/or processing of municipal solid waste, or another source of carbon-containing waste. An example of processing of waste is pyrolysis and/or gasification of waste, such as or gasification of municipal solid waste.

Categories of Fuels

A fuel is a gaseous, liquid, or solid material used as an energy source for combustion devices, including but not limited to combustion engines in land-based, aeronautical, or marine vehicles, combustion engines in generators, furnaces, boilers, and other combustion devices that are used to provide heat or power. A fuel composition is understood to refer to a gaseous, liquid, or solid material that can be used as a fuel. For certain combustion devices, proper combustion or operation of the combustion device may be ensured by controlling fuel properties. The necessary properties of a fuel for specific combustion devices may be specified in standard specification documents. In order to be suitable for its end use application in a combustion engine or other combustion device, a gaseous, liquid, or solid material may require the addition of one or more fuel additives. Fuels may be derived from renewable or conventional sources, or a combination of both. A blend of one or more fatty acid alkyl esters with a resid-containing fraction can be referred to as a fuel composition.

A fuel blending component, also referred to herein as "component" or a fuel "fraction," which may be used interchangeably in the specification and the claims, refers to a liquid constituent that is blended with other fuel blending components, components, or fuel fractions into the overall fuel composition. In some cases fuel blending components may possess the appropriate properties for use in a combustion device without further modification. Fuel blending components may be combined (blended) with fuels, other fuel blending components, or fuel additives to form a finished fuel or fuel composition that possesses the appropriate properties for use in a combustion device. Fuel blending components may be derived from renewable or conventional sources.

A conventional fuel is a fuel or fuel composition derived from one or more conventional fuel blending components. Conventional fuel blending components are derived from conventional hydrocarbon sources such as crude oil, natural gas, liquid condensates, heavy oil, shale oil, and oil sands, as described in ASTM D4175.

A renewable fuel is a fuel or fuel composition derived from one or more renewable fuel blending components. Renewable fuel blending components are derived from naturally-replenishing energy sources, such as biomass, water, and electricity produced from hydropower, wind, solar, or geothermal sources. Biofuels are a subset of renewable fuels manufactured from biomass-derived feedstocks (e.g. plant or animal based materials). Examples of biofuels include, but are not limited to, fatty acid methyl esters and hydrotreated vegetable oils. The distillate boiling range fraction of a hydrotreated vegetable oil (HVO) is also referred to as renewable diesel.

Distillate flux, also referred to as "flux", is a distillate fraction that is blended with a residual fraction to form a residual fuel composition. "Total flux" collectively refers to all distillate fractions blended into a residual fuel composition. Total flux may include multiple distillate fluxes from various sources. Examples of distillate flux include diesels, gas oils, kerosenes, cycle oils, hydrotreated vegetable oil (HVO), also referred to as renewable diesel, and gas-to-liquid hydrocarbons. Distillate fluxes may be hydroprocessed to reduce sulfur content.

A hydrocarbon is a compound composed only of hydrogen and carbon atoms. As described in ASTM D4175, hydrocarbon fuels consist primarily of hydrocarbon compounds, but may also contain impurities and contaminants from the fuel's raw materials and manufacturing processes.

Definitions of Kinematic Viscosity, Operating Viscosity, and Associated Terms

"Kinematic viscosity," also referred to herein as "viscosity," is a measured quality of a liquid fuel describing its resistance to flow under gravity. Viscosity of fuels can be measured according to methods such as ASTM D445 or ISO 3104. Fuel viscosity is temperature dependent, therefore, the temperature at which a viscosity is determined must be specified (for example, "kinematic viscosity at 40° C."). In general, heating a fuel leads to a decrease in its measured viscosity, whereas cooling a fuel leads to an increase in its measured viscosity. Thus, for a given fuel, its viscosity at 40° C. would be greater than its viscosity at 50° C., and its viscosity at 50° C. would be greater than its viscosity at 100° C.

As used herein, the term "operating viscosity" or "operational viscosity" ("OV") refers to the viscosity of liquid fuel in the fuel handling system onboard a marine vessel, while the engine is in operation and the fuel handling system is delivering fuel to the engine to power a combustion process. More specifically, operating viscosity may refer to viscosity of the fuel located in a portion of the fuel handling system close to the point of fuel injection into the engine. Marine vessels may have a fuel filter close to the point of fuel injection into the engine (upstream of the point of injection) referred to as the "last chance filter" as a last opportunity for removal of contaminants from fuels to prevent contaminants from entering the engine and damaging fuel injectors or other engine parts. On a marine vessel the engine and the last chance filter close to the engine may be housed in a space referred to as the "engine room." While ambient temperature in the engine room is generally about 35° C. to 40° C., the fuel handling system may be capable of heating or cooling the fuel to different temperature, to adjust fuel viscosity to a specific targeted value or to a value within a targeted range of values. It is expected that the fuel handling system manages the fuel such that it has a similar temperature and viscosity in the last chance filter and the point of injection into the engine.

As used herein, the term "optimal operating viscosity" or "optimal viscosity" refers to a viscosity or a range of viscosity values specified by an engine manufacturer that provide ideal engine operation. For example, the engine manufacturer may specify that fuel should be injected at a kinematic viscosity ranging from about 12 cSt to about 18 cSt for optimal engine operation. To accomplish this, the fuel handling system would heat or cool the fuel as necessary to adjust its viscosity until it is within the optimal viscosity range of about 12 cSt to about 18 cSt. The lowest possible operating viscosity while remaining in the optimal operating viscosity range is about 12 cSt. Therefore, 12 cSt is referred to as the "lowest optimal operating viscosity" or "lowest optimal viscosity." As used herein, the lowest optimal operating viscosity recommended by a manufacturer is represented as $OV_o$. As previously described, a manufacturer recommended operating viscosity may be adjusted for test precision. For an $OV_o$ value this is done according to the equation $$OV_{oP}-R>OV_o$$

wherein $OV_{oP}$ is defined as a kinematic viscosity value that may be reduced by the calculated test reproducibility (R) for an ASTM D445 kinematic viscosity measurement at 100° C. and result in a value greater than the manufacturer recommended lowest optimal operating viscosity ($OV_o$). For an $OV_o$ of 12.00 cSt, the $OV_{oP}$ value of 13.65 cSt was determined to meet the requirements of the equation shown.

As used herein, the term "lowest allowable operating viscosity" or "lowest allowable viscosity" refers to the lowest possible fuel kinematic viscosity at the engine that can be used during operation of a marine engine, according to engine manufactures. For example, the engine manufacturer may specify that marine fuel must be injected at a viscosity of at least about 2 cSt at the engine inlet at all times during engine operation. To accomplish this, the fuel handling system would heat or cool the fuel as necessary to adjust its viscosity until it is above the lowest allowable operating viscosity of about 2 cSt. As used herein, the lowest allowable operating viscosity recommended by a manufacture is represented as $OV_a$. As previously described, a manufacturer recommended operating viscosity may be adjusted for test precision to provide 95% confidence. For an $OV_a$ value this is done according to the equation $$OV_{aP}-R>OVa$$

wherein $OV_{aP}$ is defined as a kinematic viscosity value that may be reduced by the calculated test reproducibility (R) for an ASTM D445 kinematic viscosity measurement at 100° C. and result in a value greater than the manufacturer recommended lowest allowable operating viscosity ($OV_a$). For an $OV_a$ of 2.000 cSt, the $OV_{aP}$ value of 2.275 cSt was determined to meet the requirements of the equation shown.

The measured kinematic viscosity of a marine fuel composition at a specified temperature (such as 100° C., or at the wax endpoint temperature) can be divided by operating viscosity to determine a ratio, were the ratio can indicate acceptable wax behavior (Ratio>1) or unacceptable wax behavior (Ratio≤1).

Definitions of Wax, Wax Behavior, Wax Flow Viscosity and Associated Terms

A paraffin wax, also referred to as "wax," is a high molecular weight hydrocarbon that can undergo a phase transition between solid and liquid.

The concept of "wax-related filter plugging" describes a condition in which there is reduced or no flow through a filter because the filter is blocked by solid-phase wax. Filter plugging may also be referred to as "filter blocking." Accumulation of wax on filters in the fuel handling system of a marine vessel can potentially starve the engine of fuel resulting in poor vessel operation or stopping a marine vessel from operating.

As used herein, the term "wax behavior" refers to how wax in a marine fuel composition interacts with filters in the fuel handling system of a marine vessel and whether it causes operational problems for the marine vessel by plugging filters in the fuel handling system. The term "acceptable wax behavior" refers to wax in a residual fuel composition that does not cause filter plugging during vessel operation. In general, the wax in the residual fuel composition will be in the molten, or liquid, state to have acceptable wax behavior. It is also possible that a residual fuel with acceptable wax behavior contains a small amount of solid-phase wax that is too low in weight to cause filter plugging. The term "unacceptable wax behavior" refers to wax in a residual fuel composition that does cause filter plugging during vessel operation and has a negative impact on vessel operation.

As used herein, the term "wax endpoint temperature," also referred to as "wax endpoint," refers to the temperature at which essentially all (98 wt. % or more) of the wax in a fuel composition is melted and in a molten, or liquid, state, at atmospheric pressure. At the wax endpoint temperature it is expected that a fuel composition is essentially free of solid wax (2 wt. % or less) and a fuel composition will not cause wax-related filter plugging during engine operation.

As used herein, the term "wax flow viscosity" ("WFV") refers to the calculated minimum kinematic viscosity at 50° C. necessary to ensure that essentially all the wax in the marine fuel composition is melted prior to fuel injection at an operational viscosity as specified by an engine manufacturer. Essentially all the wax is considered to be melted where about 98 wt. % or more of the wax in the marine fuel composition is melted (2 wt. % or less solid wax). The measured kinematic viscosity at 50° C. of a marine fuel composition can be divided by the calculated wax flow viscosity of the marine fuel composition to determine a ratio, where the ratio can indicate acceptable wax behavior (Ratio>1) or unacceptable wax behavior (Ratio≤1).

"Essentially free" as it relates to solid wax included within the fuel compositions of the specification and the claims means that the solid wax is at less than 2 wt. % within the fuel composition, and the fuel composition will not cause wax-related filter plugging during engine operation.

EXAMPLES

To facilitate a better understanding of the present invention, the following examples of certain aspects of some embodiments are given. In no way should the following examples be read to limit, or define, the entire scope of the invention.

Example 1

In this example, wax behavior of a heavy petroleum fraction is determined by measuring kinematic viscosity (KV) of the heavy petroleum fraction at a temperature of 100° C., and generating a ratio of the KV at 100° C. to the desired operating viscosity at the engine inlet. Heavy Fraction C represents a heavy petroleum fraction containing residue, specifically, vacuum tower bottoms (VTB). Four unique samples of Heavy Fraction C (C1, C2, C3, C4) were obtained for evaluation. FIG. 5 provides a detailed list of properties for the four unique samples of Heavy Fraction C. As shown in Table 1, the wax endpoint of Heavy Fraction C samples was generally found to be between 87 to 89° C. Thus, it can be confidently determined that Heavy Fraction C has a wax endpoint less than 100° C. KV at 100° C. for Heavy Fraction C was determined, and a ratio generated by dividing the KV at 100° C. by the operating viscosity at the engine inlet, which is either (a) the lowest optimal operating viscosity, $OV_o$=12.00 cSt, (b) the lowest optimal operating viscosity adjusted to account for test precision, $OV_{oP}$=13.65 cSt, (c) the lowest allowable operating viscosity, $OV_a$=2.000 cSt, or (d) the lowest allowable operating viscosity adjusted to account for test precision, $OV_{aP}$=2.275 cSt. Ratios>1 for all Heavy Fraction C samples show Heavy Fraction C has acceptable wax behavior (i.e. no wax-related filter plugging concerns) if used as a fuel on a marine vessel.

TABLE 1

| Component | Wax Endpoint, ° C. | KV at 100° C., cSt | OV at Engine Inlet, cSt | Ratio, KV at 100° C. divided by OV at Engine Inlet; Ratio > 1? |
|---|---|---|---|---|
| Heavy Fraction C1 | 88 | 51.98 | 13.65 | 3.8; Yes |
| | | | 12.00 | 4.3; Yes |
| | | | 2.275 | 23; Yes |
| | | | 2.000 | 26; Yes |
| Heavy Fraction C2 | 88 | 44.75 | 13.65 | 3.3; Yes |
| | | | 12.00 | 3.7; Yes |
| | | | 2.275 | 20; Yes |
| | | | 2.000 | 22; Yes |
| Heavy Fraction C3 | 87 | 48.47 | 13.65 | 3.6; Yes |
| | | | 12.00 | 4.0; Yes |
| | | | 2.275 | 21; Yes |
| | | | 2.000 | 24; Yes |
| Heavy Fraction C4 | 89 | 48.17 | 13.65 | 3.5; Yes |
| | | | 12.00 | 4.0; Yes |
| | | | 2.275 | 21; Yes |
| | | | 2.000 | 24; Yes |

Example 2

In this example, wax behavior of a heavy petroleum fraction is determined by calculating kinematic viscosity (KV) of the heavy petroleum fraction at its wax endpoint temperature, and generating a ratio of the kinematic viscosity at the wax endpoint temperature to the operating viscosity at the engine inlet. Specifically, the viscosities of Heavy Fraction C1 and Heavy Fraction C3 at its wax endpoint were calculated. As shown in Table 2, Heavy Fraction C1 wax endpoint was determined by DSC, and viscosity was tested at 40° C. and 100° C. To determine the viscosity of Heavy Fraction C1 at its wax endpoint, the ASTM D341 procedure was followed using its viscosity at 40° C. and 100° C., and solving for viscosity at wax endpoint using an online calculator as previously described. When the kinematic viscosity at the 88° C. wax endpoint for Heavy Fraction C1 was calculated according to ASTM D341, the viscosity was calculated to be 83 cSt. A ratio was generated by dividing by the calculated KV at the wax endpoint by the by the operating viscosity at the engine inlet, which is either (a) the lowest optimal operating viscosity, $OV_o$=12.00 cSt, (b) the lowest optimal operating viscosity adjusted to account for test precision, $OV_{oP}$=13.65 cSt, (c) the lowest allowable operating viscosity, $OV_a$=2.000 cSt, or (d) the lowest allowable operating viscosity adjusted to account for test precision, $OV_a$=2.275 cSt. Ratios>1 for Heavy Fraction C1 show Heavy Fraction C1 has acceptable wax behavior (i.e. no wax-related filter plugging concerns) if used as a fuel on a marine vessel. Also shown in Table 2, Heavy Fraction C3 wax endpoint was determined by DSC, and viscosity was tested at 50° C. and 100° C. To determine the viscosity of Heavy Fraction C3 at its wax endpoint, the ASTM D341 procedure was followed using its viscosity at 50° C. and 100° C., and solving for viscosity at wax endpoint using an online calculator as previously described. When the kinematic viscosity at the 87° C. wax endpoint for Heavy Fraction C3 was calculated according to ASTM D341, the viscosity was calculated to be 75 cSt. A ratio was generated by dividing by the calculated KV at the wax endpoint by the by the operating viscosity at the engine inlet, which is either (a) the lowest optimal operating viscosity, $OV_o$=12.00 cSt, (b) the lowest optimal operating viscosity adjusted to account for test precision, $OV_{oP}$=13.65 cSt, (c) the lowest allowable operating viscosity, $OV_a$=2.000 cSt, or (d) the lowest allowable operating viscosity adjusted to account for test precision, $OV_{aP}$=2.275 cSt. Ratios>1 for Heavy Fraction C3 show Heavy Fraction C3 has acceptable wax behavior (i.e. no wax-related filter plugging concerns) if used as a fuel on a marine vessel.

Example 3

Figure 6:
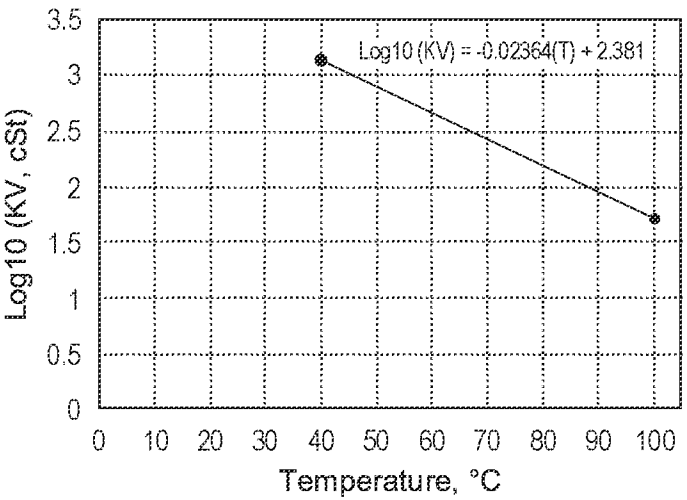
FIG. 6 illustrates a graph of the log of the kinematic viscosity versus temperature for Heavy Fraction C and calculating wax flow viscosity.

In this example, wax behavior of a heavy petroleum fraction is determined by calculating wax flow viscosity, and generating a ratio of the KV at 50° C. to the wax flow viscosity. Specifically, wax flow viscosity was determined for Heavy Fraction C1 and Heavy Fraction C3. See FIG. 6 for an illustration of the wax flow viscosity calculation for Heavy Fraction C1, and Table 3. For Heavy Fraction C1, the wax flow viscosity was calculated using: the measured KVs at 40° C. and 100° C., the measured wax endpoint temperature, and either (a) the lowest optimal operating viscosity, $OV_o$=12.00 cSt, or (b) the lowest allowable operating viscosity, $OV_a$=2.000 cSt. A ratio was generated by dividing by the measured KV at 50° C. by the calculated wax flow viscosity values. Ratios>1 for Heavy Fraction C1 show Heavy Fraction C1 has acceptable wax behavior (i.e. no wax-related filter plugging concerns) if used as a fuel on a marine vessel. This means that wax related filter plugging would not occur if a marine vessel attempts to operate using Heavy Fraction C1, or, said another way, heat may be applied to Heavy Fraction C1 to ensure all wax is in a molten state while resulting in an operating viscosity that is in the allowable range (i.e. between about 2 cSt to less than about 12 cSt) or the optimal range (i.e. between about 12 cSt to about 18 cSt). For Heavy Fraction C3, the wax flow viscosity was calculated using: the measured KVs at 50° C. and 100° C., the measured wax endpoint temperature, and either (a) the lowest optimal operating viscosity, $OV_o$=12.00 cSt, or (b) the lowest allowable operating viscosity, $OV_a$=2.000 cSt. A ratio was generated by dividing by the measured KV at 50° C. by the calculated wax flow viscosity values. Ratios>1 for Heavy Fraction C3 show Heavy Fraction C3 has acceptable wax behavior (i.e. no wax-related filter plugging concerns) if used as a fuel on a marine vessel. This means that wax related filter plugging would not occur if a marine vessel attempts to operate using Heavy Fraction C3, or, said another way, heat may be applied to Heavy Fraction C3 to ensure all wax is in a molten state while resulting in an operating viscosity that is in the allowable range (i.e. between about 2 cSt to less than about 12 cSt) or the optimal range (i.e. between about 12 cSt to about 18 cSt).

TABLE 2

| Component | KV at 40° C., cSt | KV at 50° C., cSt | KV at 100° C., cSt | Wax Endpoint, ° C. | Kinematic Viscosity at Wax Endpoint, cSt, Calculated by ASTMD341 | OV at Engine Inlet, cSt | Ratio, Calculated KV at Wax Endpoint divided by OV at Engine Inlet; Ratio >1? |
|---|---|---|---|---|---|---|---|
| Heavy Fraction C1 | 1362 | — | 51.98 | 88 | 83 | 13.65 | 6.2; Yes |
| | | | | | | 12.00 | 6.9; Yes |
| | | | | | | 2.275 | 37; Yes |
| | | | | | | 2.000 | 42; Yes |
| Heavy Fraction C3 | — | 410.5 | 48.47 | 87 | 75 | 13.65 | 5.5; Yes |
| | | | | | | 12.00 | 6.3; Yes |
| | | | | | | 2.275 | 33; Yes |
| | | | | | | 2.000 | 38; Yes |

TABLE 3

| Component | KV at 40° C., cSt | KV at 50° C., cSt | KV at 100° C., cSt | Wax Endpoint, ° C. | m | OV at Engine Inlet, cSt | Wax Flow Viscosity, cSt | Ratio, KV at 50° C. divided by Wax Flow Viscosity; Ratio >1? |
|---|---|---|---|---|---|---|---|---|
| Heavy Fraction C1 | 1362 | 638.7 | 51.98 | 88 | −0.02364 | 12.00 | 94.9 | 6.7; Yes |
| | | | | | | 2.000 | 15.8 | 40; Yes |
| Heavy Fraction C3 | — | 410.5 | 48.47 | 87 | −0.01856 | 12.00 | 58.3 | 7.0; Yes |
| | | | | | | 2.000 | 9.72 | 42; Yes |

Example 4

In this example, wax behavior is determined for Fuel A, a fuel composition created by blending a heavy petroleum fraction (Heavy Petroleum Fraction C1) and a distillate flux (Distillate Flux 1). Detailed properties of Fuel A are provided in FIG. 7. The wax endpoint of Fuel A was determined by DSC and found to be less than 100° C. (Table 4). First, wax behavior was determined for Fuel A using the approach of measuring kinematic viscosity (KV) of the fuel composition at a temperature of 100° C., and generating a ratio of the KV at 100° C. to the operating viscosity, which is in this example is either (a) the lowest optimal operating viscosity, $OV_o$=12.00 cSt, (b) the lowest optimal operating viscosity adjusted to account for test precision, $OV_{oP}$=13.65 cSt, (c) the lowest allowable operating viscosity, $OV_a$=2.000 cSt, or (d) the lowest allowable operating viscosity adjusted to account for test precision, $OV_a$=2.275 cSt. Ratios≤1 for $OV_o$ and $OV_{oP}$ indicate that Fuel A has unacceptable wax behavior if operated at the lowest optimal viscosity. This means that wax related filter plugging could occur if a marine vessel attempts to operate Fuel A at an operating viscosity of about 12 cSt or 13.65 cSt or higher, or, said another way, applying sufficient heat to Fuel A to ensure all wax is in a molten state results in an operating viscosity that is not in the correct range to provide ideal engine operation (i.e. between about 12 to 18 cSt). Ratios>1 for $OV_a$ and $OV_{aP}$ indicate Fuel A has acceptable wax behavior if operated at the lowest allowable viscosity. This means that wax related filter plugging would not occur if a marine vessel attempts to operate Fuel A at an operating viscosity of about 2 cSt or 2.275 cSt, or, said another way, applying sufficient heat to Fuel A to ensure all wax is in a molten state results in an operating viscosity that is in the allowable range (i.e. between about 2 cSt to less than about 12 cSt).

Next, wax behavior of Fuel A is determined by calculating kinematic viscosity (KV) of the fuel composition at its wax endpoint temperature, and generating a ratio of the KV at the wax endpoint temperature to the operating viscosity (Table 5), which is in this example is either (a) the lowest optimal operating viscosity, $OV_o$=12.00 cSt, (b) the lowest optimal operating viscosity adjusted to account for test precision, $OV_{oP}$=13.65 cSt, (c) the lowest allowable operating viscosity, $OV_a$=2.000 cSt, or (d) the lowest allowable operating viscosity adjusted to account for test precision, $OV_a$=2.275 cSt. Ratios≤1 for $OV_o$ and $OV_{oP}$ indicate that Fuel A has unacceptable wax behavior if operated at the lowest optimal viscosity. This means that wax related filter plugging could occur if a marine vessel attempts to operate Fuel A at an operating viscosity of about 12 cSt or 13.65 cSt or higher, or, said another way, applying sufficient heat to Fuel A to ensure all wax is in a molten state results in an operating viscosity that is not in the correct range to provide ideal engine operation (i.e. between about 12 to 18 cSt). Ratios>1 for $OV_a$ and $OV_a$ indicate Fuel A has acceptable wax behavior if operated at the lowest allowable viscosity. This means that wax related filter plugging would not occur if a marine vessel attempts to operate Fuel A at an operating viscosity of about 2 cSt or 2.275 cSt, or, said another way, applying sufficient heat to Fuel A to ensure all wax is in a molten state results in an operating viscosity that is in the allowable range (i.e. between about 2 cSt to less than about 12 cSt).

Figure 8:
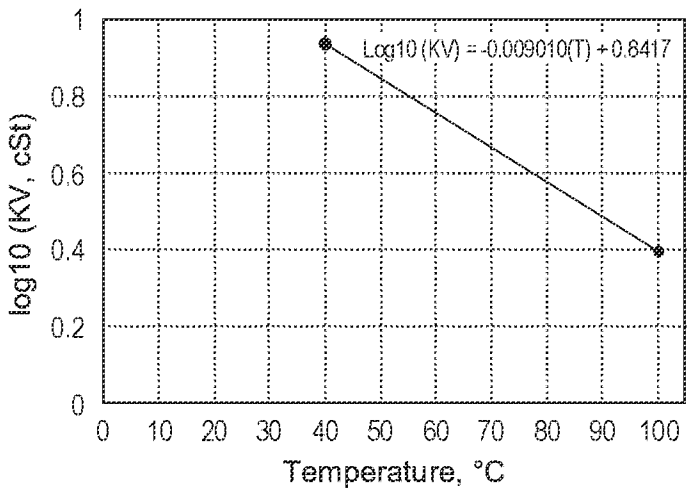
FIG. 8 illustrates a graph of the log of the kinematic viscosity versus temperature for Fuel A and calculating wax flow viscosity.

Finally, wax behavior of Fuel A is determined by calculating wax flow viscosity, and generating a ratio of the KV at 50° C. to the wax flow viscosity (see Table 6 and FIG. 8). The wax flow viscosity was calculated using: the measured KVs at 40° C. and 100° C. for the blend, the measured wax endpoint temperature for the blend, and either (a) the lowest optimal operating viscosity, $OV_o$=12.00 cSt, or (b) the lowest allowable operating viscosity, $OV_a$=2.000 cSt. A ratio was generated by dividing by the measured KV at 50° C. by the calculated wax flow viscosity values. Ratio≤1 for $OV_o$ indicates that Fuel A has unacceptable wax behavior if operated at the lowest optimal viscosity. This means that wax related filter plugging could occur if a marine vessel attempts to operate Fuel A at an operating viscosity of about 12 cSt or higher, or, said another way, applying sufficient heat to Fuel A to ensure all wax is in a molten state results in an operating viscosity that is not in the correct range to provide ideal engine operation (i.e. between about 12 to 18 cSt). Ratio>1 for $OV_a$ indicates Fuel A has acceptable wax behavior if operated at the lowest allowable viscosity. This means that wax related filter plugging would not occur if a marine vessel attempts to operate Fuel A at an operating viscosity of about 2 cSt, or, said another way, applying sufficient heat to Fuel A to ensure all wax is in a molten state results in an operating viscosity that is in the allowable range (i.e. between about 2 cSt to less than about 12 cSt).

TABLE 4

| | Heavy Fraction C1 | Distillate Flux 1 | Fuel A |
|---|---|---|---|
| Heavy Fraction C1 vol. % | 100 | 0 | 25 |
| Distillate Flux 1 vol. % | 0 | 100 | 75 |

TABLE 4-continued

| | Heavy Fraction C1 | Distillate Flux 1 | Fuel A | | | |
|---|---|---|---|---|---|---|
| Wax Endpoint, ° C. | 88 | — | 66 | | | |
| Kinematic Viscosity at 100° C., cSt | 51.98 | — | 2.481 | | | |
| | | OV at Engine Inlet, cSt | 13.65 | 12.00 | 2.275 | 2.000 |
| | | Ratio, KV at 100° C. divided by OV at Engine Inlet; Ratio > 1? | 0.18; No | 0.21; No | 1.1; Yes | 1.2; Yes |

TABLE 5

| | Heavy Fraction C1 | Distillate Flux 1 | Fuel A | | | |
|---|---|---|---|---|---|---|
| Heavy Fraction C1 vol. % | 100 | 0 | 25 | | | |
| Distillate Flux 1 vol. % | 0 | 100 | 75 | | | |
| Wax Endpoint, ° C. | 88 | — | 66 | | | |
| KV at 40° C., cSt | 1362 | 2.888 | 8.615 | | | |
| KV at 100° C., cSt | 51.98 | — | 2.481 | | | |
| Calculated KV at Wax Endpoint, by ASTM D341, cSt | 84 | — | 4.5 | | | |
| | | OV at Engine Inlet, cSt | 13.65 | 12.00 | 2.275 | 2.000 |
| | | Ratio, Calculated KV at wax endpoint divided by OV at Engine Inlet; Ratio > 1? | 0.33; No | 0.38; No | 2.0; Yes | 2.3; Yes |

TABLE 6

| Component | KV at 40° C., cSt | KV at 50° C., cSt | KV at 100° C., cSt | Wax Endpoint, ° C. | m | OV at Engine Inlet, cSt | Wax Flow Viscosity, cSt | Ratio, KV at 50° C. divided by Wax Flow Viscosity; Ratio >1? |
|---|---|---|---|---|---|---|---|---|
| Fuel A | 8.615 | 6.618 | 2.481 | 66 | −0.0091 | 12.00 | 16.7 | 0.40 ; No |
| | | | | | | 2.000 | 2.79 | 2.37 ; Yes |

Example 5

In this example, wax behavior is determined for Fuel B, a second fuel composition created by blending a heavy petroleum fraction (Heavy Petroleum Fraction C1) and a distillate flux (Distillate Flux 2). Detailed properties of Fuel B are provided in FIG. 7. Compared to the prior example (Example 4, Fuel A) a key difference in the fuel composition is the quality of Distillate Flux 2. Distillate Flux 2 is characterized by a slightly lower kinematic viscosity, measured at 40° C. and 100° C., which results in a slightly lower viscosity blended fuel composition holding other components and concentrations of components constant.

First, wax behavior of Fuel B is determined using the approach of measuring kinematic viscosity (KV) of the fuel composition at a temperature of 100° C., and generating a ratio of the KV at 100° C. to the operating viscosity at the engine inlet (Table 7), which is in this example is either (a) the lowest optimal operating viscosity, $OV_o$=12.00 cSt, (b) the lowest optimal operating viscosity adjusted to account for test precision, $OV_{oP}$=13.65 cSt, (c) the lowest allowable operating viscosity, $OV_a$=2.000 cSt, or (d) the lowest allowable operating viscosity adjusted to account for test precision, $OV_a$=2.275 cSt. Ratios≤1 for $OV_o$, $OV_{oP}$, and $OV_a$ indicate that Fuel B has unacceptable wax behavior if operated at the lowest optimal viscosity, and the lowest allowable viscosity after adjusting for test precision. This means that wax related filter plugging could occur if a marine vessel attempts to operate Fuel B at an operating viscosity of about 2.275 cSt or 12 cSt or 13.65 cSt or higher, or, said another way, applying sufficient heat to Fuel B to ensure all wax is in a molten state results in an operating viscosity that is not in the correct range to provide ideal engine operation (i.e. between about 12 to 18 cSt) nor in the allowable range after accounting for test precision. Ratio>1 for $OV_a$ indicate Fuel B has acceptable wax behavior if operated at the lowest allowable viscosity, but the finding is not robust in view of test reproducibility. This means that wax related filter plugging may not occur if a marine vessel attempts to operate Fuel B at an operating viscosity of about 2 cSt, or, said another way, applying sufficient heat to Fuel B to ensure all wax is in a molten state results in an operating viscosity that at least about 2.000 cSt, but less than about 2.275 cSt, the lowest allowable operating viscosity adjusted to account for test precision.

Next, wax behavior of Fuel B is determined by calculating kinematic viscosity (KV) of the fuel composition at its wax endpoint temperature, and generating a ratio of the KV at the wax endpoint temperature to the operating viscosity at the engine inlet (Table 8), which is in this example is either (a) the lowest optimal operating viscosity, $OV_o$=12.00 cSt, (b) the lowest optimal operating viscosity adjusted to account for test precision, $OV_{oP}$=13.65 cSt, (c) the lowest allowable operating viscosity, $OV_a$=2.000 cSt, or (d) the lowest allowable operating viscosity adjusted to account for test precision, $OV_{aP}$=2.275 cSt. Ratios≤1 for $OV_o$ and $OV_{oP}$ indicate that Fuel B has unacceptable wax behavior if operated at the lowest optimal viscosity. This means that wax related filter plugging could occur if a marine vessel attempts to operate Fuel B at an operating viscosity of about 12 cSt or 13.65 cSt or higher, or, said another way, applying sufficient heat to Fuel B to ensure all wax is in a molten state results in an operating viscosity that is not in the correct range to provide ideal engine operation (i.e. between about 12 to 18 cSt). Ratios>1 for $OV_a$ and $OV_{aP}$ indicate Fuel B has acceptable wax behavior if operated at the lowest allowable viscosity. This means that wax related filter plugging would not occur if a marine vessel attempts to operate Fuel B at an operating viscosity of about 2 cSt or 2.275 cSt, or, said another way, applying sufficient heat to Fuel B to ensure all wax is in a molten state results in an operating viscosity that is in the allowable range (i.e. between about 2 cSt to less than about 12 cSt).

Figure 9:
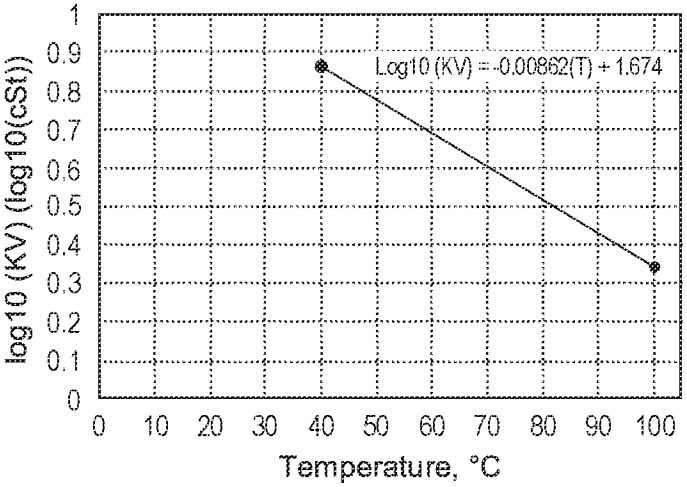
FIG. 9 illustrates a graph of the log of the kinematic viscosity versus temperature for Fuel B and calculating wax flow viscosity.

Finally, wax behavior of Fuel B is determined by calculating wax flow viscosity, and generating a ratio of the KV at 50° C. to the wax flow viscosity (See Table 9 and FIG. 9). The wax flow viscosity was calculated using: the measured KVs at 40° C. and 100° C. for the blend, the measured wax endpoint temperature for the blend, and either (a) the lowest optimal operating viscosity, $OV_o$=12.00 cSt, or (b) the lowest allowable operating viscosity, $OV_a$=2.000 cSt. A ratio was generated by dividing by the measured KV at 50° C. by the calculated wax flow viscosity values. Ratio≤1 for $OV_o$ indicates that Fuel B has unacceptable wax behavior if operated at the lowest optimal viscosity. This means that wax related filter plugging could occur if a marine vessel attempts to operate Fuel B at an operating viscosity of about 12 cSt or higher, or, said another way, applying sufficient heat to Fuel B to ensure all wax is in a molten state results in an operating viscosity that is not in the correct range to provide ideal engine operation (i.e. between about 12 to 18 cSt). Ratio>1 for $OV_a$ indicates Fuel B has acceptable wax behavior if operated at the lowest allowable viscosity. This means that wax related filter plugging would not occur if a marine vessel attempts to operate Fuel B at an operating viscosity of about 2 cSt, or, said another way, applying sufficient heat to Fuel B to ensure all wax is in a molten state results in an operating viscosity that is in the allowable range (i.e. between about 2 cSt to less than about 12 cSt). It is noted in this example that the approach of generating a ratio of the KV at 100° C. to the operating viscosity provides an outcome of Ratio≤1, which does not match the outcome of generating a ratio of the KV at wax endpoint to the operating viscosity or generating a ratio of the KV50 to the wax flow viscosity, which both provide an outcome of Ratio>1. As illustrated in this example, for some embodiments, the approach of generating a ratio of the KV at 100° C. to the operating viscosity may incorrectly predict that a fuel composition has unacceptable wax behavior. In these cases, other approaches may be used, such as (1) calculate a KV at the wax endpoint, and assess wax behavior using the approach of determining the ratio of KV at wax endpoint to the operating viscosity, as described in FIG. 1, or (2) assess by calculating wax flow viscosity, and generating a ratio of the KV at 50° C. to the wax flow viscosity, as described in FIG. 2.

TABLE 7

| | Heavy Fraction C1 | Distillate Flux 2 | Fuel B | | | |
|---|---|---|---|---|---|---|
| Heavy Fraction C1 vol. % | 100 | 0 | 25 | | | |
| Distillate Flux 2 vol. % | 0 | 100 | 75 | | | |
| Wax Endpoint, ° C. | 88 | — | 69 | | | |
| Kinematic Viscosity at 100° C., cSt | 51.98 | — | 2.209 | | | |
| | | OV at Engine Inlet, cSt | 13.65 | 12.00 | 2.275 | 2.000 |
| | | Ratio, KV at 100° C. divided by OV at Engine Inlet; Ratio > 1? | 0.16; No | 0.18; No | 0.97; No | 1.1; Yes |

TABLE 8

| | Heavy Fraction C1 | Distillate Flux 2 | Fuel B |
|---|---|---|---|
| Heavy Fraction C1 vol. % | 100 | 0 | 25 |

TABLE 8-continued

| | Heavy Fraction C1 | Distillate Flux 2 | | Fuel B | |
|---|---|---|---|---|---|
| Distillate Flux 2 vol. % | 0 | 100 | | 75 | |
| Wax Endpoint, ° C. | 88 | — | | 69 | |
| KV at 40° C., cSt | 1362 | 2.888 | | 7.27 | |
| KV at 100° C., cSt | 51.98 | — | | 2.209 | |
| Calculated KV at Wax Endpoint, by ASTM D341, cSt | 84 | — | | 3.708 | |
| | | OV at Engine Inlet, cSt | 13.65 | 12.00 | 2.275 | 2.000 |
| | | Ratio, Calculated KV at wax endpoint divided by OV at Engine Inlet; Ratio > 1? | 0.27; No | 0.31; No | 1.6; Yes | 1.9; Yes |

TABLE 9

| Component | KV at 40° C., cSt | KV at 50° C., cSt | KV at 100° C., cSt | Wax Endpoint, ° C. | m | OV at Engine Inlet, cSt | Wax Flow Viscosity, cSt | Ratio, KV at 50° C. divided by Wax Flow Viscosity; Ratio > 1? |
|---|---|---|---|---|---|---|---|---|
| Fuel B | 7.27 | 5.741 | 2.209 | 69 | −0.00862 | 12.00 | 17.5 | 0.33; No |
| | | | | | | 2.000 | 2.92 | 1.97; Yes |

Example 6

Figure 11:
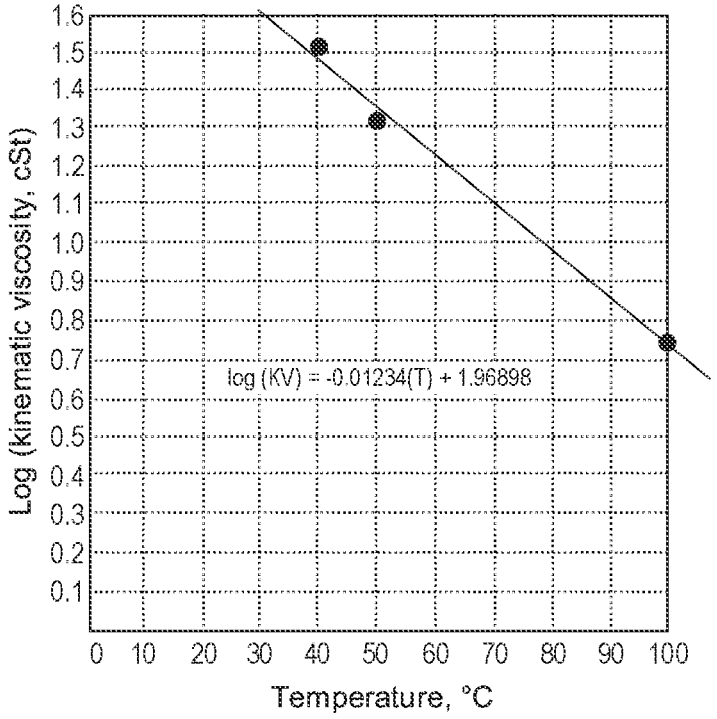
FIG. 11 illustrates a graph of the log of the kinematic viscosity versus temperature for Fuel C.

In this example, wax behavior of Fuel C is determined by calculating wax flow viscosity, and generating a ratio of the KV at 50° C. to the wax flow viscosity. See Table 10 and FIG. 10 and FIG. 11. The wax flow viscosity was calculated using: the measured KVs at 40° C., 50° C., and 100° C., the measured wax endpoint temperature, and either (a) the lowest optimal operating viscosity, $OV_o$=12.00 cSt, or (b) the lowest allowable operating viscosity, $OV_a$=2.000 cSt. A ratio was generated by dividing by the measured KV at 50° C. by the calculated wax flow viscosity values. Ratio≤1 for $OV_o$ indicates that Fuel C has unacceptable wax behavior if operated at the lowest optimal viscosity. This means that wax related filter plugging could occur if a marine vessel attempts to operate Fuel C at an operating viscosity of about 12 cSt or higher, or, said another way, applying sufficient heat to Fuel C to ensure all wax is in a molten state results in an operating viscosity that is not in the correct range to provide ideal engine operation (i.e. between about 12 to 18 cSt). Ratio>1 for $OV_a$ indicates Fuel C has acceptable wax behavior if operated at the lowest allowable viscosity. This means that wax related filter plugging would not occur if a marine vessel attempts to operate Fuel C at an operating viscosity of about 2 cSt, or, said another way, applying sufficient heat to Fuel C to ensure all wax is in a molten state results in an operating viscosity that is in the allowable range (i.e. between about 2 cSt to less than about 12 cSt).

TABLE 10

| Component | KV at 40° C., cSt | KV at 50° C., cSt | KV at 100° C., cSt | Wax Endpoint, ° C. | m | OV at Engine Inlet, cSt | Wax Flow Viscosity, cSt | Ratio, KV at 50° C. divided by Wax Flow Viscosity; Ratio >1? |
|---|---|---|---|---|---|---|---|---|
| Fuel C | 32.17 | 20.57 | 5.51 | 81 | −0.01234 | 12.00 | 29.0 | 0.71; No |
| | | | | | | 2.000 | 4.8 | 4.29; Yes |

Example 7

Figure 12:
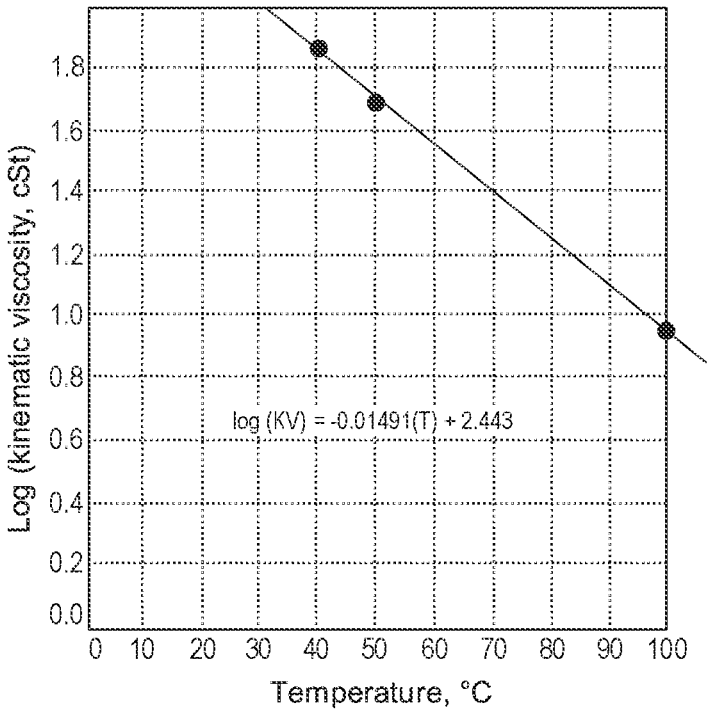
FIG. 12 illustrates a graph of the log of the kinematic viscosity versus temperature for Fuel D.

In this example, wax behavior of Fuel D is determined by calculating wax flow viscosity, and generating a ratio of the KV at 50° C. to the wax flow viscosity. See Table 11 and FIG. 10 and FIG. 12. The wax flow viscosity was calculated using: the measured KVs at 40° C., 50° C., and 100° C., the measured wax endpoint temperature, and either (a) the lowest optimal operating viscosity, $OV_o$=12.00 cSt, or (b) the lowest allowable operating viscosity, $OV_a$=2.000 cSt. A ratio was generated by dividing by the measured KV at 50° C. by the calculated wax flow viscosity values. Ratios>1 for $OV_o$ and $OV_a$ indicate Fuel D has acceptable wax behavior if used as a fuel on a marine vessel. This means that wax related filter plugging would not occur if a marine vessel attempts to operate using Fuel D, or, said another way, heat may be applied to Fuel D to ensure all wax is in a molten state while resulting in an operating viscosity that is in the allowable range (i.e. between about 2 cSt to less than about 12 cSt) or the optimal range (i.e. between about 12 cSt to about 18 cSt).

TABLE 11

| Component | KV at 40° C., cSt | KV at 50° C., cSt | KV at 100° C., cSt | Wax Endpoint, ° C. | m | Wax Flow Viscosity, cSt | Ratio, KV at 50° C. divided by Wax Flow Viscosity; Ratio >1? |
|---|---|---|---|---|---|---|---|
| Fuel D | 72.06 | 48.33 | 9.00 | 81 | −0.01491 | 34.8 | 1.39; Yes |
| | | | | | | 5.80 | 8.33; Yes |

Example 9

In this example, the wax behavior of Heavy Component A7 is determined using the approach of measuring kinematic viscosity (KV) of the fuel composition at a temperature of 100° C., and generating a ratio of the KV at 100° C. to the operating viscosity at the engine inlet (Table 12), which is in this example is either (a) the lowest optimal operating viscosity, $OV_o$=12.00 cSt, (b) the lowest optimal operating viscosity adjusted to account for test precision, $OV_{oP}$=13.65 cSt, (c) the lowest allowable operating viscosity, $OV_a$=2.000 cSt, or (d) the lowest allowable operating viscosity adjusted to account for test precision, $OV_{aP}$=2.275 cSt. Ratios>1 for Heavy Fraction A7 show Heavy Fraction A7 has acceptable wax behavior (i.e. no wax-related filter plugging concerns) if used as a fuel on a marine vessel. This means that wax related filter plugging would not occur if a marine vessel attempts to operate using Heavy Fraction A7, or, said another way, heat may be applied to Heavy Fraction A7 to ensure all wax is in a molten state while resulting in an operating viscosity that is in the allowable range (i.e. between about 2 cSt to less than about 12 cSt) or the optimal range (i.e. between about 12 cSt to about 18 cSt).

TABLE 12

| Component | KV at 40° C., cSt | KV at 50° C., cSt | KV at 100° C., cSt | Wax Endpoint, ° C. | m | Ratio, Calculated KV at Wax Endpoint divided by Minimum KV at Engine Inlet; Ratio >1? |
|---|---|---|---|---|---|---|
| Heavy Fraction A7 | 708432 | 3710 | 102 | 3281 | 13.65 | 240; Yes |
| | | | | | 12.00 | 273; Yes |
| | | | | | 2.275 | 1442; Yes |
| | | | | | 2.000 | 1641; Yes |

Example 10

In this example, ten different heavy fractions and ten different distillate fluxes were used to prepare several different sample marine fuel compositions, identified as Fuels 1-27. FIG. 13 shows the properties of the different heavy fractions and fluxes used in this example, identified as HFs (heavy fractions) and DFs (fluxes). Wax flow viscosities were calculated according to the previously described approach using the lowest optimal operating viscosity recommended by the engine manufacturer ("$OV_o$") as the operating viscosity in the calculation. FIG. 14 shows the properties of the sample blended marine fuel compositions with acceptable wax behaviors (i.e., a ratio of KV50 to wax flow viscosity of greater than 1). As illustrated, Fuels 1-17 have a ratio of KV50 to wax flow viscosity greater than 1, indicating acceptable wax behavior. FIG. 15 shows the properties of the different sample blended marine fuel compositions with unacceptable wax behaviors. As illustrated, Fuels 18-25 have a ratio of KV50 to wax flow viscosity of less than or equal to 1, indicating unacceptable wax behavior.

PCT/EP Clauses:

1. A marine fuel composition having the following enumerated properties: a kinematic viscosity at 50° C. of 5 cSt to 700 cSt; a wax endpoint temperature of less than 100° C.; and a ratio of kinematic viscosity at 100° C. to operating viscosity greater than 1, wherein the operating viscosity is at least 2 cSt, and wherein the marine fuel composition exists in a liquid phase with essentially all the wax in the composition melted (essentially free of solid wax) prior to fuel injection into a marine engine.

2. The marine fuel composition of clause 1, where the sulfur content is 0.50 wt. % or less by weight of the marine fuel composition.

3. The marine fuel composition of clauses 1-2, wherein the density at 15° C. of the to composition is 0.86 g/cm3 to 1.01 g/cm3.

4. The marine fuel composition of clauses 1-3, wherein the T90 distillation point of the composition is 450° C. to 750° C.

5. The marine fuel composition of clauses 1-4, wherein the carbon residue of the composition is 0.5 wt. % to 18 wt. %.

6. The marine fuel composition of clauses 1-5, wherein the asphaltene content of the composition is 0.5 wt. % to 10 wt. %.

7. The marine fuel composition of clauses 1-6, wherein the marine fuel composition is a distillate marine fuel.

8. The marine fuel composition of clauses 1-6, wherein the marine fuel composition is a residual marine fuel.

9. A marine fuel composition having the following enumerated properties: a kinematic viscosity at 50° C. of 5 cSt to 700 cSt; a wax endpoint temperature of 35° C. to 130° C.; and a ratio of kinematic viscosity at wax endpoint temperature to operating viscosity greater than 1, wherein the operating viscosity is at least 2 cSt, and wherein the marine fuel composition exists in a liquid phase with essentially all the wax in the composition melted (essentially free of solid wax) prior to fuel injection into a marine engine.

10. The marine fuel composition of clause 9, wherein the sulfur content is 0.50 wt. % or less by weight of the marine fuel composition.

11. The marine fuel composition of clauses 9-10, wherein the density at 15° C. of the composition is 0.86 g/cm3 to 1.01 g/cm3.

12. The marine fuel composition of clauses 9-11, wherein the T90 distillation point of the composition is 450° C. to 750° C.

13. The marine fuel composition of clauses 9-12, wherein the carbon residue of the composition is 0.5 wt. % to 18 wt. %.

14. The marine fuel composition of clauses 9-13, wherein the asphaltene content of the composition is 0.5 wt. % to 10 wt. %.

15. The marine fuel composition of clauses 9-14, wherein the marine fuel composition is a distillate marine fuel.

16. The marine fuel composition of clauses 9-14, wherein the marine fuel composition is a residual marine fuel.

17. A marine fuel composition having the following enumerated properties: a kinematic viscosity at 50° C. of 5 cSt to 700 cSt; a wax endpoint temperature of 35° C. to 130° C.; and a ratio of kinematic viscosity at 50° C. to wax flow viscosity of greater than 1, wherein the wax to flow viscosity is calculated using an operating viscosity of 2 cSt, and wherein the marine fuel composition exists in a liquid phase with essentially all the wax in the composition melted (essentially free of solid wax) prior to fuel injection into a marine engine.

18. The marine fuel composition of clause 17, wherein the wax flow viscosity is calculated using an operating viscosity of 12 cSt.

19. The marine fuel composition of clauses 17-18, wherein the sulfur content is 0.50 wt. % or less by weight of the marine fuel composition.

20. The marine fuel composition of clauses 17-19, wherein the density at 15° C. of the composition is 0.86 g/cm3 to 1.01 g/cm3.

21. The marine fuel composition of clauses 17-20, wherein the T90 distillation point of the composition is 450° C. to 750° C.

22. The marine fuel composition of clauses 17-21, wherein the carbon residue of the composition is 0.5 wt. % to 18 wt. %.

23. The marine fuel composition of clauses 17-22, wherein the asphaltene content of the composition is 0.5 wt. % to 10 wt. %.

24. The marine fuel composition of clauses 17-23, wherein the marine fuel composition is a distillate marine fuel.

25. The marine fuel composition of clauses 17-23, wherein the marine fuel composition is a residual marine fuel.

While the invention has been described with respect to a number of embodiments and examples, those skilled in the art, having benefit of this disclosure, will appreciate that other embodiments can be devised which do not depart from the scope and spirit of the invention as disclosed herein. Although individual embodiments are discussed, the invention covers all combinations of all those embodiments.

While compositions, methods, and processes are described herein in terms of "comprising," "containing," "having," or "including" various components or steps, the compositions and methods can also "consist essentially of" or "consist of" the various components and steps. The phrases, unless otherwise specified, "consists essentially of" and "consisting essentially of" do not exclude the presence of other steps, elements, or materials, whether or not, specifically mentioned in this specification, so long as such steps, elements, or materials, do not affect the basic and novel characteristics of the invention, additionally, they do not exclude impurities and variances normally associated with the elements and materials used.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited.

The invention claimed is:

1. A marine fuel composition having the following enumerated properties:

a kinematic viscosity at 50° C. of about 5 cSt to about 100 cSt;

a wax endpoint temperature of less than about 100° C.;

a kinematic viscosity at 100° C. of at least 2 cSt; and a carbon residue of 0.5 wt % to 10 wt %.

2. The marine fuel composition of claim 1, wherein the kinematic viscosity at 100° C. is at least 10 cSt.

3. The marine fuel composition of claim 1, wherein the sulfur content of the composition is about 0.50 wt. % or less by weight of the marine fuel composition.

4. The marine fuel composition of claim 1, wherein the density at ° C. of the composition is about 0.86 g/cm3 to about 1.01 g/cm3.

5. The marine fuel composition of claim 1, wherein the T90 distillation point of the composition is about 450° C. to about 750° C.

6. The marine fuel composition of claim 1, wherein the carbon residue of the composition is about 0.5 wt. % to about 5 wt. %.

7. The marine fuel composition of claim 1, wherein the asphaltene content of the composition is about 0.5 wt. % to about 10 wt. %.

8. A marine fuel composition having the following enumerated properties:

a kinematic viscosity at 50° C. of about 5 cSt to about 700 cSt;

a wax endpoint temperature of about 35° C. to about 130° C.;

a kinematic viscosity at wax endpoint temperature of at least 2 cSt; and a carbon residue of 0.5 wt % to 10 wt %.

9. The marine fuel composition of claim 8, wherein the kinematic viscosity at wax endpoint temperature is at least 10 cSt.

10. The marine fuel composition of claim 8, wherein the sulfur content is about 0.50 wt. % or less by weight of the marine fuel composition.

11. The marine fuel composition of claim 8, wherein the density at ° C. of the composition is about 0.86 g/cm3 to about 1.01 g/cm3.

12. The marine fuel composition of claim 8, wherein the T90 distillation point of the composition is about 450° C. to about 750° C.

13. The marine fuel composition of claim 8, wherein the carbon residue of the composition is about 0.5 wt. % to about 5 wt. %.

14. The marine fuel composition of claim 8, wherein the asphaltene content of the composition is about 0.5 wt. % to about 10 wt. %.

15. A marine fuel composition having the following enumerated properties:

a kinematic viscosity at 50° C. of about 5 cSt to about 100 cSt;

a wax endpoint temperature of 100° C. or less;

a kinematic viscosity at 100° C. at least 2 cSt; and a T90 distillation point of 450° C. or more.

16. The marine fuel composition of claim 15, wherein the kinematic viscosity at 100° C. at least 10 cSt.

17. The marine fuel composition of claim 15, wherein the sulfur content is about 0.50 wt. % or less by weight of the marine fuel composition.

18. The marine fuel composition of claim 15, wherein the density at ° C. of the composition is about 0.86 g/cm3 to about 1.01 g/cm3.

19. The marine fuel composition of claim 15, wherein the T90 distillation point of the composition is about 450° C. to about 750° C.

20. The marine fuel composition of claim 15, wherein the carbon residue of the composition is about 0.5 wt. % to about 18 wt. %.

21. The marine fuel composition of claim 15, wherein the asphaltene content of the composition is about 0.5 wt. % to about 10 wt. %.

* * * * *